US006997548B2

(12) United States Patent
Matsuo et al.

(10) Patent No.: US 6,997,548 B2
(45) Date of Patent: Feb. 14, 2006

(54) TANK HOLDER, LIQUID TANK AND TANK ATTACHING AND DETACHING METHOD

(75) Inventors: Keisuke Matsuo, Kanagawa (JP); Tetsuya Ohashi, Chiba (JP); Hiroki Hayashi, Kanagawa (JP); Kenji Kitabatake, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 95 days.

(21) Appl. No.: 10/667,314

(22) Filed: Sep. 23, 2003

(65) Prior Publication Data

US 2004/0076447 A1 Apr. 22, 2004

(30) Foreign Application Priority Data

Sep. 30, 2002 (JP) ..... 2002-287725

(51) Int. Cl.
*B41J 2/175* (2006.01)

(52) U.S. Cl. ..... 347/86; 347/49

(58) Field of Classification Search ..... 347/37, 347/49, 85, 86, 87

See application file for complete search history.

(56) References Cited

U.S. PATENT DOCUMENTS 5,250,957 A * 10/1993 Onozato ..... 347/7
5,619,237 A * 4/1997 Inoue et al. ..... 347/86
5,815,183 A * 9/1998 Sasaki ..... 347/86
6,234,618 B1 * 5/2001 Yamamoto et al. ..... 347/86
6,361,158 B1 * 3/2002 Inoue et al. ..... 347/86
6,488,369 B1 * 12/2002 Steinmetz et al. ..... 347/86
6,863,376 B1 * 3/2005 Seino et al. ..... 347/49

* cited by examiner

*Primary Examiner*—Anh T. N. Vo
(74) *Attorney, Agent, or Firm*—Fitzpatrick, Cella, Harper & Scinto

(57) ABSTRACT

A recording head cartridge in which ink tanks include a removal preventing pawl which is provided at a rear surface of an ink container and engages with a tank holder, and a latch lever which is provided at a front surface of the ink container and which has a latch pawl engaging with the tank holder. The height of a rear wall and a side surface of the tank holder are set to be lower than corresponding heights of the ink tank. During removal, the container abuts the upper end of the peripheral wall of the tank holder an dis rotated about this upper end so that a part of the side surface of the container is protruded externally of the holder. Accordingly, a space required to remove the container form the tank holder is placed external of the peripheral wall of the tank holder. Thus, removal space ordinarily wasted by a conventional tank holder can be eliminated.

13 Claims, 15 Drawing Sheets

TANK HOLDER, LIQUID TANK AND TANK ATTACHING AND DETACHING METHOD

BACKGROUND OF THE INVENTION

1. Field of the Invention

The present invention relates to a tank holder for detachably holding a liquid tank, a liquid tank mounted to the holder and a method for attaching or detaching the liquid tank with respect to the tank holder.

2. Description of the Prior Art

There has been conventionally proposed a recording apparatus for recording on a recording medium such as paper, fabric, plastic sheet or OHP (overhead projector) sheet so as to be capable of mounting a recording head which applies various recording systems including wire-dot system, heat-sensitive system, heat-transfer system and ink-jet system.

Among various types of recording apparatus, an ink-jet recording apparatus is utilized as a printer serving as an output terminal of output means for information processing system including copy machines, facsimiles, electronic typewriters, word processors and work stations or a portable printer included in personal computers, host computers, optical disk devices or video devices.

An ink tank for supplying an ink to a recording head has a container for accommodating an ink, an ink absorber for absorbing and holding the ink and a cover for sealing the container.

Examples of the recording head include an ink tank-integrated recording head which is configured integrally with an ink tank and an ink tank exchangeable recording head in which an ink tank is detachably provided.

Because of improvements in reliability of recording heads and low running costs, an ink-jet recording apparatus which uses an ink tank exchangeable recording head cartridge has been recently utilized widely. In particular, in order to correspond to color printing, an ink jet recording apparatus to which a plurality of ink tanks (e.g., two ink tanks for black and color (cyan, magenta, yellow) or four ink tanks for black, cyan, magenta and yellow) are mounted is accepted in the market.

In the case of the ink tank exchangeable recording head cartridge, positioning the relative position of an ink tank with a recording head for the purpose of reliably supplying an ink from the ink tank to the recording head is an important matter for recording quality.

For this reason, it is important to realize compactness and to obtain a structure which is operated more simpler, has a simpler mechanism, eliminates disadvantages at the time of attachment or detachment and does not decrease the precision of positioning.

In an ink tank included in the above-described conventional ink tank exchangeable recording head cartridge, a protrusion which is engaged with a removal preventing hole of a tank holder is provided at its lower end of one side surface abutting the inner surface of the tank holder. Further, this ink tank is provided with a latch lever having a latch pawl engaged with an engagement hole of the tank holder at the other side surface opposite to the one side surface with the protrusion provided thereon. When the ink tank is mounted to the tank holder, the ink tank is rotated with respect to the tank holder about the protrusion engaged with the removal preventing hole of the tank holder, and the latch pawl is engaged with the engagement hole. As a result, the ink tank is mounted to the tank holder. When the ink tank is removed from the tank holder, it is rotated with respect to the tank holder about the protrusion engaged with the removal preventing hole of the tank holder, and the lower end portion of the one side surface with the protrusion formed thereon abuts the inner surface of the tank holder, so that the latch pawl is disengaged from the engagement hole (see Japanese Patent Application Laid-Open (JP-A) No. 10-286972 (document 1) (page 8, FIG. 4)).

An ink tank included in another conventional ink jet cartridge is provided with a second pawl engaged with a second hole of a tank holder at its lower end side of one side surface abutting the inner surface of the tank holder. Further, this ink tank is also provided with a movable lever having a first pawl engaged with a first hole of the tank holder at the other side surface opposite to the one side surface with the second pawl being provided thereon. When this ink tank is mounted to the tank holder, it is rotated with respect to the tank holder about the second pawl engaged with the second hole of the tank holder, and the second pawl is engaged with the second hole. In this way, the ink tank is mounted to the tank holder. When the ink tank is removed from the tank holder, it is rotated with respect to the tank holder about the second pawl engaged with the second hole of the tank holder, and the lower end portion of the one side surface with the second pawl being formed thereon abuts the inner surface of the tank holder, so that the first pawl is disengaged from the first hole (see JP-A No. 2000-127425 (document 2) (page 4, FIG. 3)).

Nevertheless, the above-described conventional examples have the following problems.

In accordance with a portable printer, the entire printer is required to be made as compact as possible. Thus, an ink tank and a tank holder must be also configured compact. Consequently, a space required for detaching the ink tank from the tank holder must be even further small.

In order to prevent an ink supplying tube of the tank holder from interfering with the bottom surface of the ink tank at the time of removing the ink tank from the tank holder, an ink supplying port of the ink tank must be large or be provided so as to be apart from an engagement protrusion.

For color printing, four color inks, i.e., cyan, magenta, yellow and black inks are required. If there is a relatively large space, independent ink tanks for these four color inks are desirable. Nevertheless, a portable printer usually comprises two ink tanks, i.e., a black ink tank and a color ink tank (which is an ink tank with accommodating chambers for three colors, i.e., cyan, magenta and yellow) because its compactness is demanded.

In particular, as in the aforementioned color ink tank, when three accommodating chambers are formed by dividing its inner portion into three parts, it is preferable, in view of its usage, to equally diving into three accommodating chambers so as to have the same internal volume. This is also preferable in view of its manufacturing because common components can be used. Nevertheless, when an ink tank with relatively small capacity is attached or detached as described above, it is always significantly difficult to accomplish the same time the structure for forming three accommodating chambers with the same internal volume and the structure for preventing an interference with an ink supplying tube.

In accordance with the above-described conventional recording head cartridges, when an ink tank is removed from a tank holder, a space in which the top surface portion of the ink tank rotated with respect to the tank holder is moved is ensured within the tank holder. For this reason, in conventional tank holders, in order to ensure the aforementioned space, the upper end side of its peripheral wall is formed so as to be bent externally of an ink tank. This results in a large tank holder and thus a large recording head cartridge (see documents 1 and 2).

SUMMARY OF THE INVENTION

An object of the present invention is to provide a liquid tank, a tank holder and a tank mounting method that can remove a space required for attachment or detachment operation for the liquid tank from the tank holder, prevent an interference of the liquid tank with the tank holder at a time of attaching or detaching the liquid tank and realize compact and thin tank holder.

In order to accomplish the aforementioned object, a tank holder of the present invention comprises a liquid discharge head; a tank mounting portion to which a liquid tank for accommodating liquid to be supplied to the liquid discharge head is detachably mounted; a terminal for transmitting a recording signal to the liquid discharge head; a liquid supplying tube which is placed on the mounting surface of the mounting portion on which the liquid tank is mounted and supplies the liquid supplied from the liquid tank to the liquid discharge head; a peripheral wall which is provided upright around the mounting surface of the tank mounting portion and forms a space for accommodating the liquid tank; a first engagement portion which is provided at one side wall of the peripheral wall and engaged with a first engagement protrusion provided at a part of the liquid tank; and a second engagement portion which is provided at the other side wall of the peripheral wall opposing the one side wall and engaged with a second engagement protrusion provided at the other portion of the liquid tank.

The height of at least the one side wall of the peripheral wall is lower than the height of the liquid tank to be mounted, and when the liquid tank is mounted to the tank mounting portion, at least one side surface of the peripheral wall abuts the side surface of the liquid tank.

The height of the side surface of the holder corresponding to one side surface of a container is lower than that of the liquid tank. Thus, the container can be removed in such a manner that the one side surface of the container abuts the upper end of the peripheral wall for the tank holder and the container is rotated about the upper end so that a part of the one side surface of the container is protruded externally of the holder.

In accordance with this holder, a space required for removing the container from the tank holder is placed external of the peripheral wall of the tank holder. Thus, a waste space ensured within the aforementioned conventional tank holder in order to remove the liquid tank can be eliminated. For this reason, a head cartridge can be made compact, and the tank holder and the entire head cartridge can be made compact and thin.

A liquid tank configured so as to be attachable or detachable to the tank holder described above comprises a container main body for accommodating liquid; an air communication portion for communicating the inside of the container main body with air; a supplying port which is provided on the bottom surface of the container main body in the state the liquid tank is mounted to the tank holder and supplies the liquid to the liquid discharge head; a first engagement protrusion which is provided at one side surface of the liquid tank and engaged with the first engagement portion provided at one side wall of a peripheral wall for constituting the tank mounting portion; and a lever portion with a second engagement protrusion which is engaged with the second engagement portion provided at the other side wall of the peripheral wall opposing the one side wall and provided so as to be elastically displaced. The protruding amount of the first engagement protrusion from one side surface of the liquid tank is smaller than the distance from the bottom surface of the container main body to the first engagement protrusion.

When the container is removed from the tank holder, it is possible to prevent the first engagement protrusion from interfering with the tank holder. As a result, a degree of freedom for disposing the supplying port on the container is improved.

The lower surface of the first engagement protrusion of the liquid tank opposing the bottom surface is preferably formed as an inclined surface which is inclined upward from its proximal end toward its distal end. Thus, a mounting force applied by a user acting at a time of mounting the tank is successfully distributed, so that the mounting is easily performed. Even if the liquid tank is mounted in a wrong manner, the tank is reliably mounted and thus a reliability for mounting is improved.

In a state where the container is mounted to the tank holder, the position of the second engagement protrusion for the liquid tank from the bottom surface is higher than that of the first engagement protrusion. Thus, when the container is removed from the tank holder, the one side surface with the first engagement protrusion being formed thereon passes externally of the tank holder with respect to the engagement portion of the tank holder engaged with the first engagement protrusion. As a result, a space required for attaching or detaching the liquid tank within the tank holder can be made smaller.

In the state where the container is mounted to the tank holder, the one side surface of the container for the liquid tank abuts the inner surface of the peripheral wall for the tank holder opposing the one side surface. When the container is removed from the tank holder, the one side surface of the container abuts the upper end of peripheral wall of the tank holder and the container is rotated about this upper end. It is configured so that the one side surface of the container abuts the upper end of peripheral wall of the tank holder and the container is rotated about this upper end, and thus the container is removed from the tank holder. The container is rotated so that a part of the one side surface for the container is protruded externally of the peripheral wall of the tank holder. In accordance with this liquid tank, because a space required for removing the container from the tank holder is placed external of the peripheral wall of the tank holder, a waste space ensured within the aforementioned conventional tank holder in order to remove the liquid tank can be eliminated. Accordingly, in accordance with the liquid tank, a head cartridge can be made compact and the tank holder and the entire head cartridge can be made compact and thin.

A center of rotation of the container for the liquid tank which abuts the upper end of the peripheral wall for the tank holder to be rotated is placed at a position which is equal to or lower than ½ of the height of the container from the bottom surface. Thus, the one side surface of the container abuts the upper end of peripheral wall of the tank holder and the container is rotated about the substantial central portion of the one side surface of the container. In this way, the container can be easily rotated. Further, the rotational operation of the container is stabilized. When the center of rotation is lowered from the substantial central portion toward the bottom surface, the container is further easily rotated.

Further, there provided a method for attaching or detaching a liquid tank with respect to a tank holder to which the liquid tank accommodating liquid is mounted, comprising the step of: rotating the liquid tank with respect to the tank holder with the upper end of peripheral wall of the tank holder which surrounds the liquid tank mounted to the tank holder being a supporting point and removing the liquid tank.

DETAILED DESCRIPTION OF THE PREFERRED EMBODIMENTS

A recording head cartridge and a recording apparatus relating to a specific embodiment of the present invention will be described hereinafter with reference to the drawings.

Figure 1:
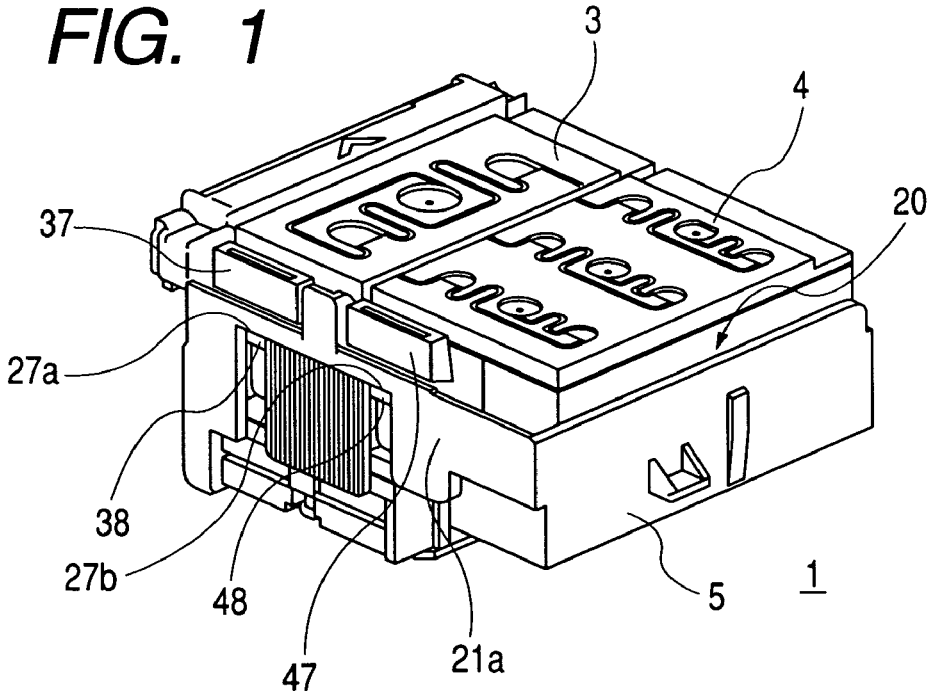
FIG. 1 is a perspective view of a recording head cartridge relating to the present invention, seen from the front.
Figure 2:
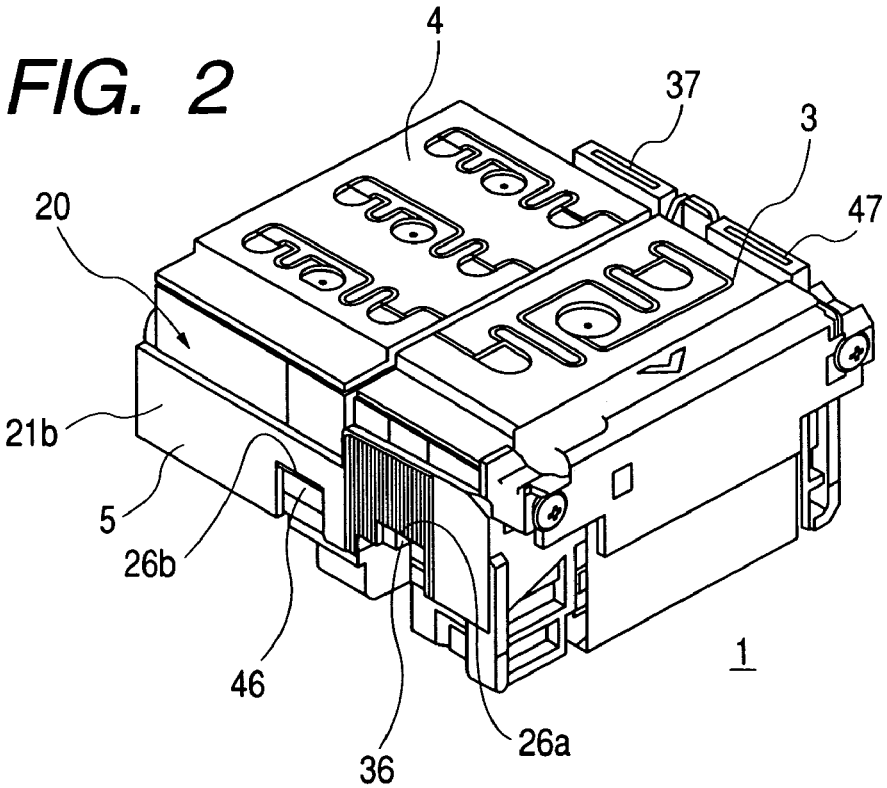
FIG. 2 is a perspective view of the recording head cartridge seen from the rear.
Figure 3:
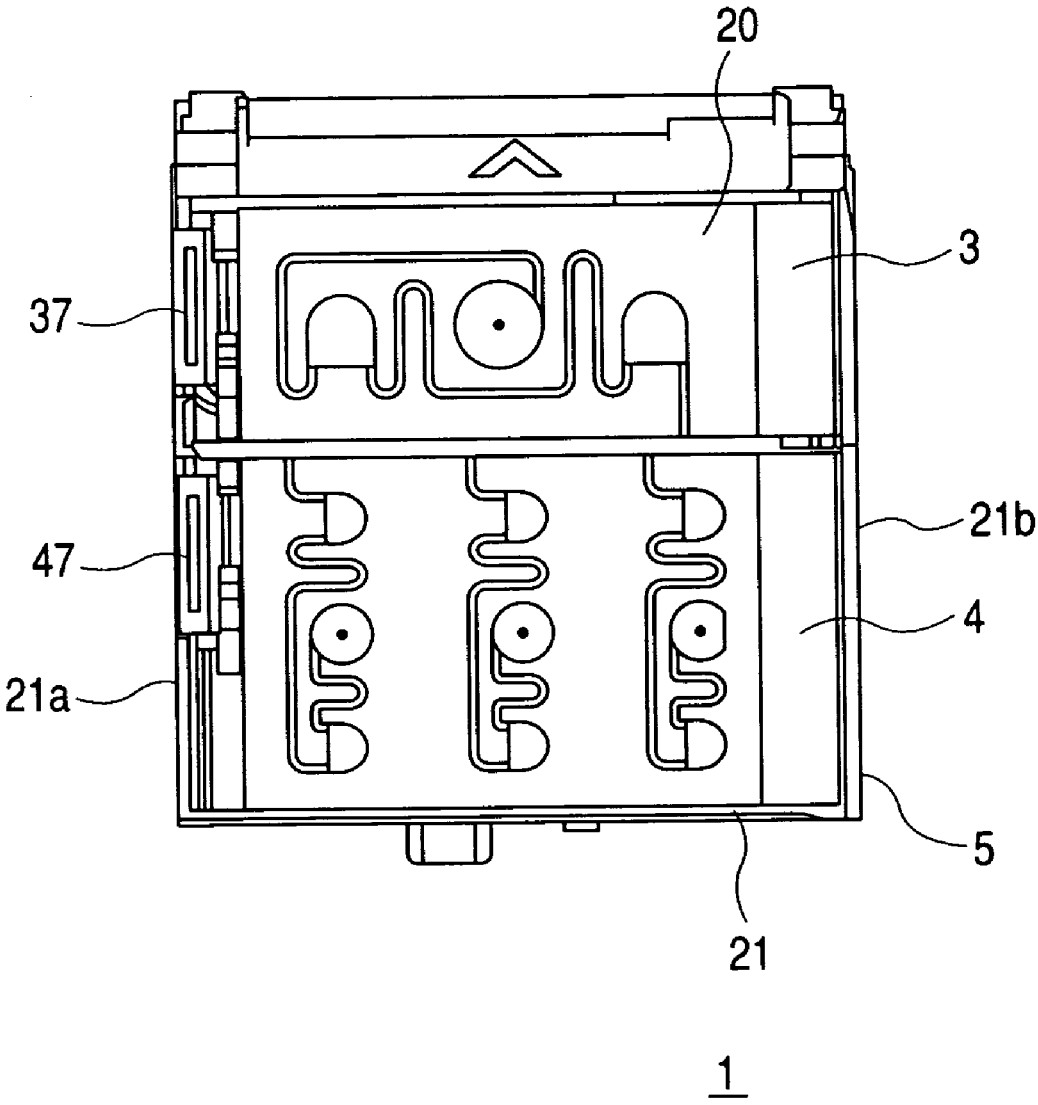
FIG. 3 is a plan view of the recording head cartridge.

FIG. 1 is a perspective view of the recording head cartridge of this embodiment, seen from the front. FIG. 2 is a perspective view of the recording head cartridge seen from the rear. FIG. 3 is a plan view of the recording head cartridge.

As illustrated in FIGS. 1, 2 and 3, the recording head cartridge 1 comprises a recording head (not illustrated) for ejecting inks, a black ink tank 3 for supplying a black ink to the recording head, a color ink tank 4 for supplying a color ink to the recording head and a tank holder 5 to which the black ink tank 3 and the color ink tank 4 are detachably mounted.

Although not illustrated, the recording head has a plurality of nozzle lines on which discharge holes for ejecting inks of the respective colors are arranged and an electric resistance element which generates a thermal energy for discharging inks supplied from the ink tanks. The recording head performs recording by ejecting ink droplets by using an thermal energy applied from the electric resistance element, e.g., by film boiling.

Figure 5:
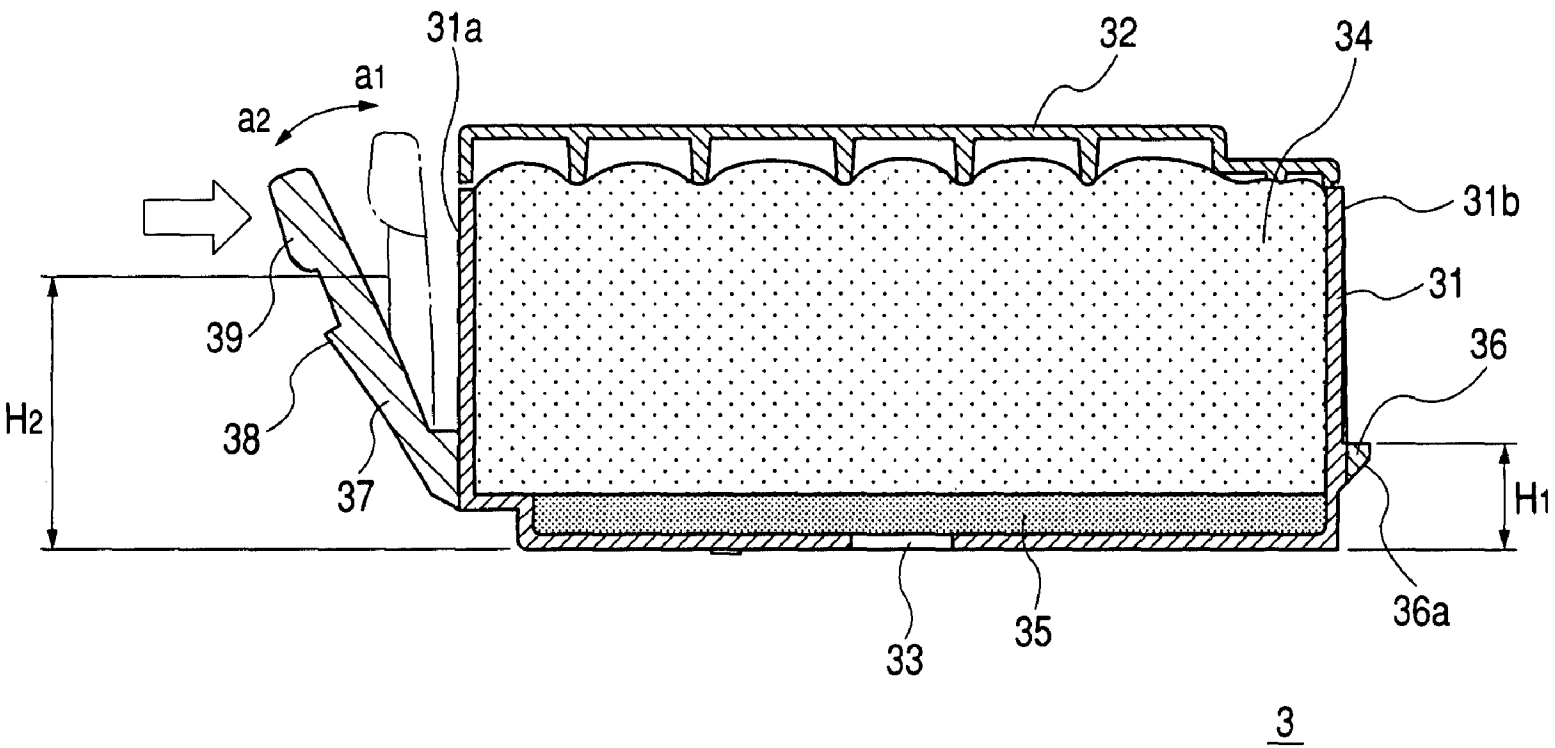
FIG. 5 is a cross-sectional view of a black ink tank mounted to the tank holder.
Figure 6:
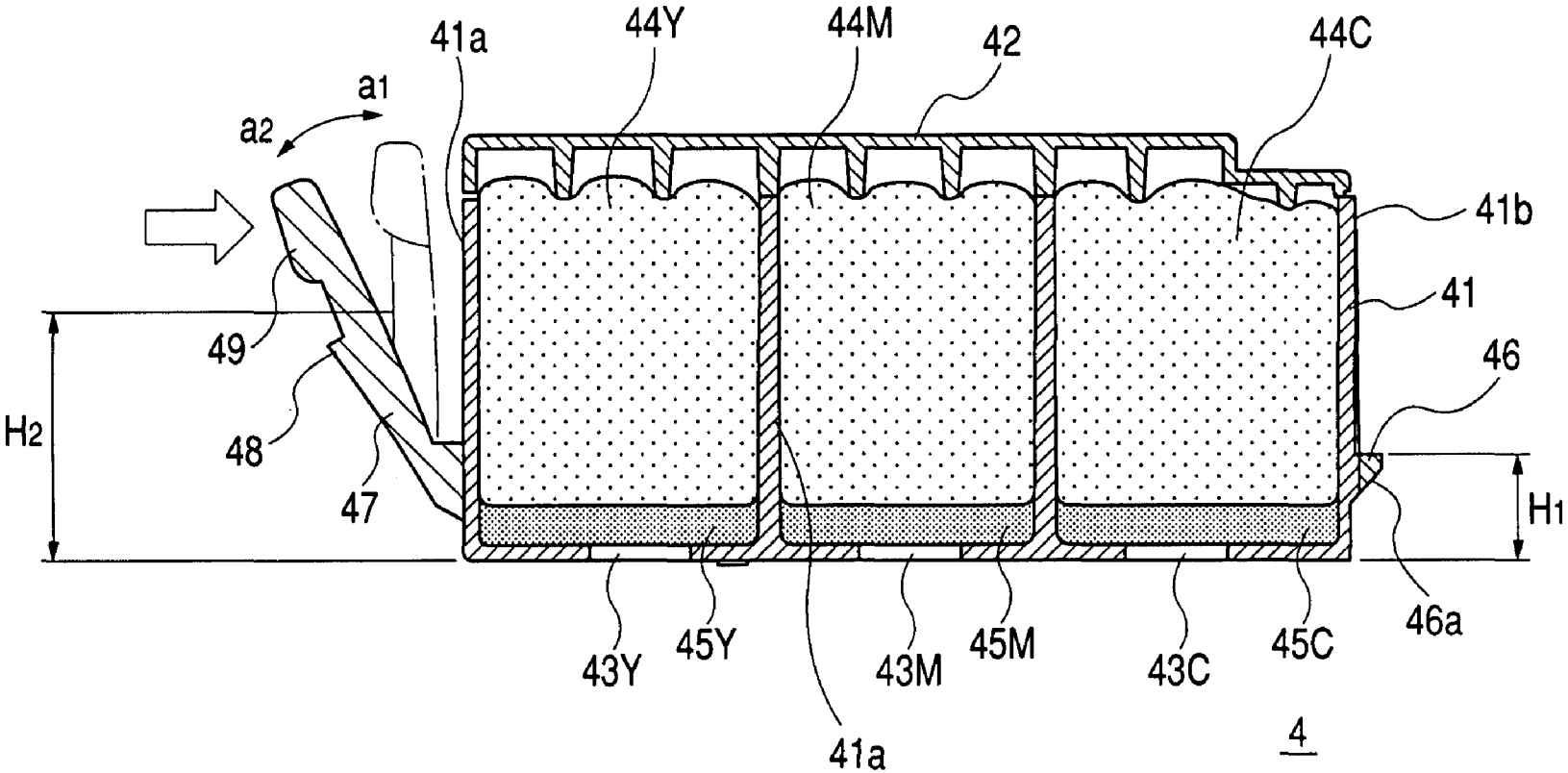
FIG. 6 is a cross-sectional view of a color ink tank mounted to the tank holder.

FIG. 5 is a cross-sectional view of the black ink tank 3 provided in the recording head cartridge of the present invention. FIG. 6 is a cross-sectional view of the color ink tank 4 provided in the recording head cartridge. Internal structures of these ink tanks are not limited to these cases and the present invention is of course not limited by such structures.

As illustrated in FIGS. 1 and 2, the black ink tank 3 and the color ink tank 4 are mounted within the tank holder 5 so as to be adjacent with each other.

Figure 4:
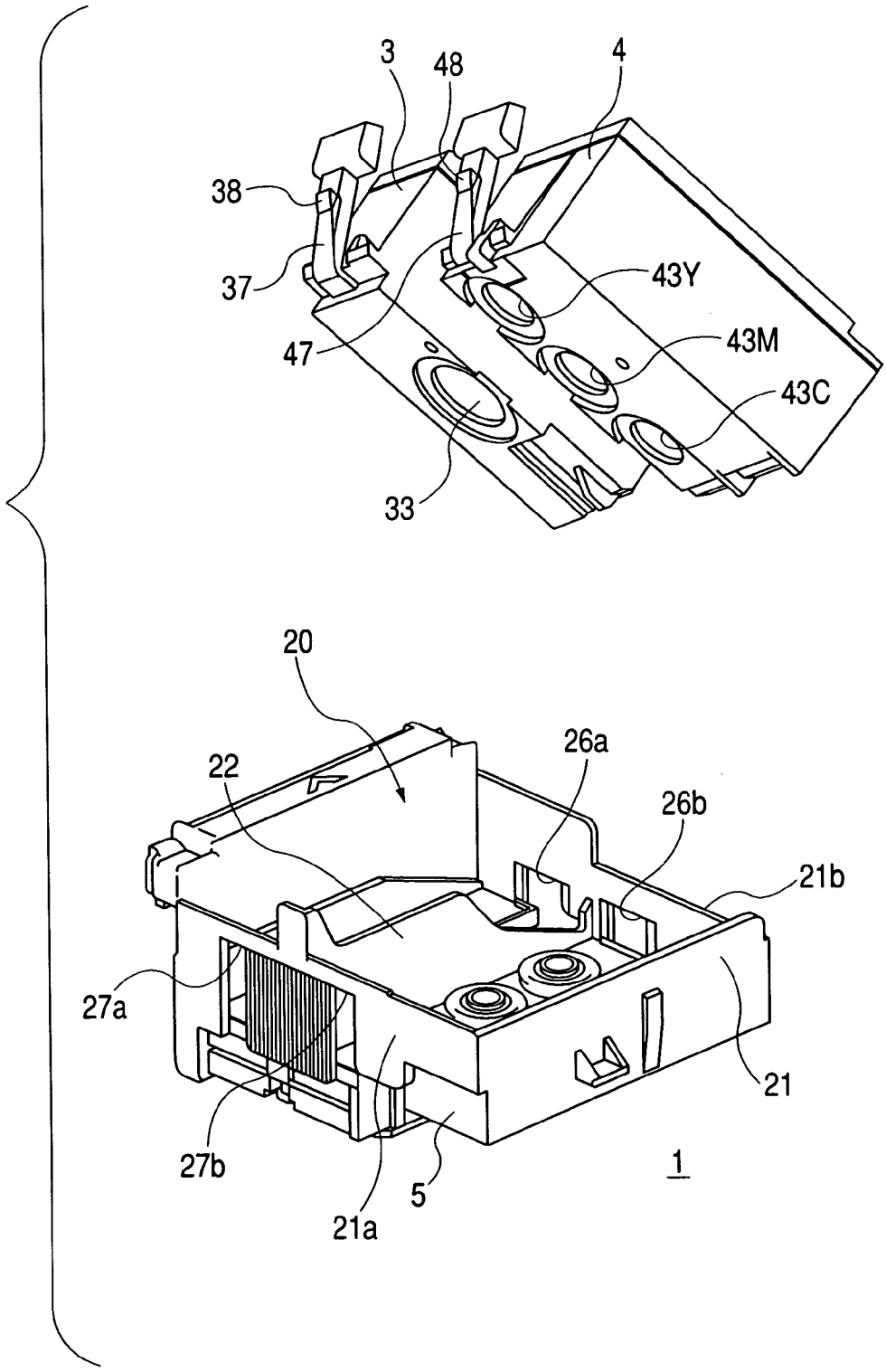
FIG. 4 is an exploded perspective view illustrating the state where ink tanks are removed from a tank holder.

As illustrated in FIG. 4, the black ink tank 3 has a box-shaped container 31 which has a bottom surface and an accommodating chamber for accommodating a black ink therein and a cover 32 for covering the opening of the container 31 to seal the same with an air-hole being formed thereon.

An ink supplying port 33 into which an ink supplying tube 23 for black ink provided at the tank holder 5, which will be described later, is inserted is formed at the bottom portion of the container 31. The ink supplying port 33 is sealed by a sealing member (not illustrated). Thus, it is possible to prevent an ink from leaking from the black ink tank 3 before the tank is mounted to the tank holder 5.

An ink absorber 34 is accommodated within the container 31. A black ink is absorbed by the ink absorber 34 and held thereby. An ink supplying member 35 for supplying an ink to the tank holder 5 is provided between the ink absorber 34 and the ink supplying port 33 within the container 31. The upper end surface of the ink supplying member 35 closely contacts the ink absorber 34. Further, the ink supplying member 35 is disposed so as to close the ink supplying port 33 from inside of the container 31.

The ink absorber 34 and the ink supplying member 35 impregnate an ink and hold the same. The ink holding ability (capillary force) of the ink supplying member 35 is set to be higher than that of the ink absorber 34. Thus, an ink held by the ink absorber 34 is effectively led to the ink supplying member 35 and an efficiency of consuming the ink held by the ink absorber 34 is improved.

A fiber-collected member is used for the ink absorber 34 and the ink supplying member 35. This fiber-collected member is prepared as follows. Namely, a web obtained by arranging a fiber made of e.g., a polyolefine-based thermoplastic resin in a direction is laminated. Then, the resultant laminated webs are compressed in a laminating direction. The ink absorber 34 uses a fiber having a fineness of around 6.7 dtex (diameter: about 54 $\mu$m) and has a density after compression of about 0.08 g/cm$^3$. The ink supplying member 35 uses a fiber having a fineness of about 2.2 dtex (diameter: about 18 $\mu$m) and has a density after compression of about 0.20 g/cm$^3$.

An ink absorbed in the ink absorber 34 is led via the ink supplying member 35 to the ink supplying port 33. When the black ink tank 3 is mounted to the tank holder 5, the ink supplying tube 23 provided at the tank holder 5, which will be described later, is inserted into the ink supplying port 33. A black ink is supplied via the ink supplying tube 23 to discharge holes (not illustrated) for black ink on the recording head. At this time, because a seal ring 24 which is provided around the ink supplying tube 23 and will be described later is set in close contact with the outer peripheral portion of the ink supplying port 33, ink leakage is suppressed.

As a structure for detachably mounting the black ink tank 3 to the tank holder 5, a removal preventing pawl 36 for preventing the black ink tank 3 from falling from the tank holder 5 is integrally formed in a protruded manner at the rear surface 31*b* of the container 31 which abuts the inner surface of the tank holder 5 when the black ink tank 3 is mounted to the tank holder 5. By this removal preventing pawl 36 engaging with a removal preventing hole 26*a* which is provided at the tank holder 5 and will be described later, the black ink tank 3 mounted to the tank holder 5 is held. This removal preventing pawl 36 is formed so that an inclined surface 36*a* which is inclined with respect to a direction perpendicular to the rear surface 31*b* of the container 31 is cut out at the lower end surface opposing the bottom surface of the container 31. This inclined surface 36*a* may be formed in a flat or curved surface.

In the outer periphery of the black ink tank 3, a latch lever 37 which is engaged with the tank holder 5 is integrally formed at the front surface 31*a* which is opposite to the rear surface 31*b* at which the removal preventing pawl 36 is provided so as to be elastically displaced in directions indicated by the arrows $a_1$ and $a_2$ in FIG. 5. The proximal end of the latch lever 37 is integrally connected to the vicinity of the bottom surface of the container 31. A latch pawl 38 which is engaged with the tank holder 5 is integrally formed so as to be protruded at the outer surface of the distal end side of the latch lever 37. The latch lever 37 is inclined so as to be gradually protruded externally of the container 31 from its proximal end side toward its distal end side. An inclined surface which slide-contacts the tank holder 5 is formed at the outer surface of the proximal end side. An operational protruding portion 39 used for pressing the latch lever 37 to elastically displace the same with respect to the container 31 when the latch pawl 38 is disengaged from the tank holder 5 is integrally formed at the distal end portion of the latch lever 37.

When the black ink tank 3 is mounted to the tank holder 5, the latch lever 37 is pressed by a front wall 21*a* of the tank holder 5 to be deflected in the direction indicated by the arrow $a_1$ in FIG. 5. The latch pawl 38 formed at the latch lever 37 is engaged with an engagement hole 27 of the tank holder 5 to be described later.

In the state where the black ink tank 3 is mounted to the tank holder 5, a height $H_2$ from the upper end surface of the latch pawl 38 for the latch lever 37 which is elastically displaced in the direction of the arrow $a_1$ with respect to the container 31 to the bottom surface of the container is set to be higher than a height $H_1$ from the upper end surface of the removal preventing pawl 36 to the bottom surface of the container.

The color ink tank 4 provided in the recording head cartridge 1 has basically the same structure as that of the black ink tank 3, and includes, as illustrated in FIG. 5, a box-shaped container 41 with a bottom surface for accommodating three color inks and a cover 42 for covering an opening of the container 41.

The container 41 is partitioned into three accommodating chambers with almost the same capacity by two partition plates 41*a* placed in parallel in order to accommodate independently three color inks. These three accommodating chambers are arranged along a longitudinal direction of the bottom surface which is perpendicular to one side wall which is rotated with respect to the tank holder 5 when the color ink tank 4 is mounted to the tank holder 5 and the other side wall.

Figure 7:
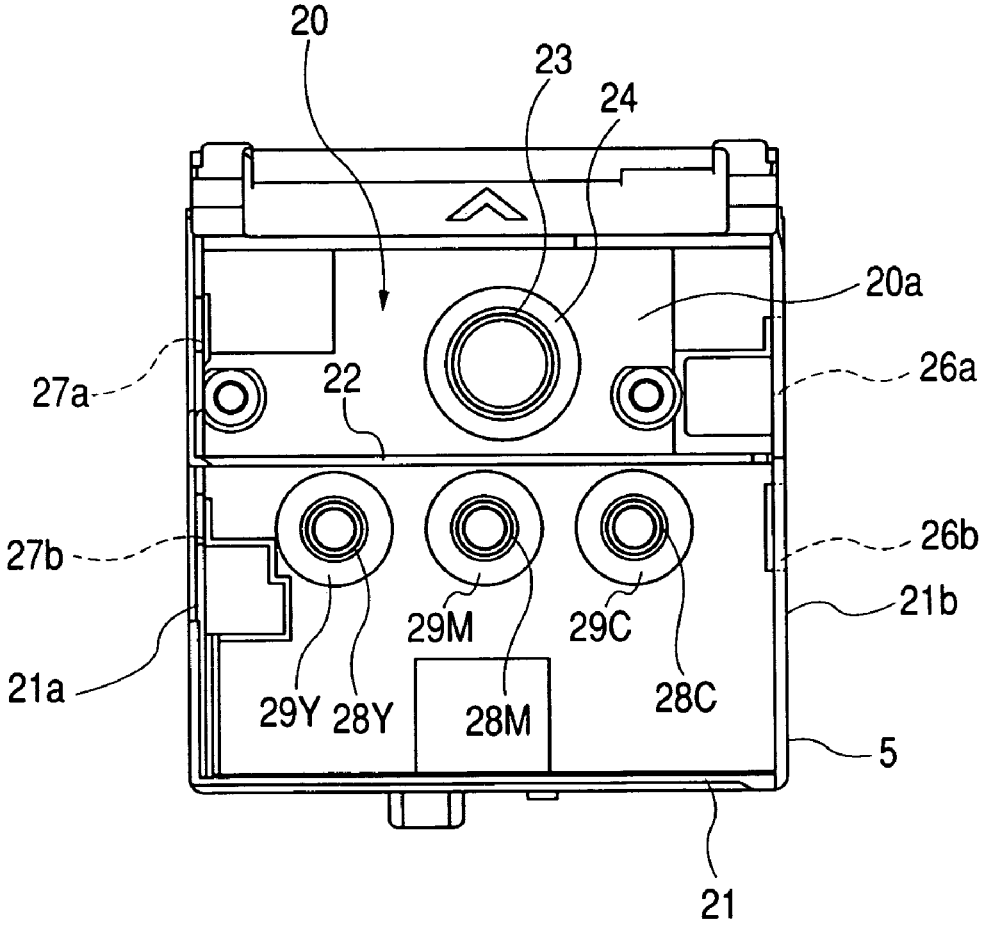
FIG. 7 is a plan view of the tank holder.

An ink absorber 44Y for absorbing a yellow ink and holding the same, an ink absorber 44M for absorbing and holding a magenta ink and an ink absorber 44C for absorbing a cyan ink and holding the same are accommodated within the respective accommodating chambers. As illustrated in FIG. 7, ink supplying ports 43Y, 43M and 43C are formed at the bottom surface of the color ink tank 4 along the longitudinal direction of the bottom surface so as to communicate with the respective accommodating chambers.

Because the accommodating chambers have the same structure as that of the accommodating chamber for the above-described black ink tank 3, descriptions thereof will be omitted. Further, as the cover 42 has the basically same structure as that of the cover for the black ink tank 3 except that air-holes are respectively provided at the accommodating chambers and the respective accommodating chambers are hermetically closed, its description will be omitted.

As in the black ink tank 3, a removal preventing pawl 46 which is engaged with the tank holder 5 is integrally formed in a protruded manner at the rear surface 41*b* of the container 41 for the color ink tank 4 as a structure for detachably mounting the color ink tank 4 to the tank holder 5. This removal preventing pawl 46 is formed so that an inclined surface 46*a* inclined with respect to a direction perpendicular to the rear surface 41*b* of the container 41 is cut out at the lower end surface opposing the bottom surface of the container 41. This inclined surface 46*a* may be formed in a flat or curved surface.

In the outer periphery of the color ink tank 4, a latch lever 47 which is engaged with the tank holder 5 is integrally formed at the front surface 41*a* which is opposite to the rear surface 41*b* at which the removal preventing pawl 46 is provided so as to be elastically displaced in directions of the arrows $a_1$ and $a_2$ in FIG. 6. The proximal end of the latch lever 47 is integrally connected to the vicinity of the bottom surface of the container 41. A latch pawl 48 which is engaged with the color ink tank 4 is integrally formed so as to be protruded at the outer surface of the distal end side of the latch lever 47. The latch lever 47 is inclined so as to be gradually protruded externally of the container 41 from its proximal end side toward its distal end side. An inclined surface which slide-contacts the tank holder 5 is formed at the outer surface of the proximal end side. An operational protruding portion 49 used for pressing the latch lever 47 to elastically displace the same with respect to the container 41 when the latch pawl 48 is disengaged from the tank holder 5 is integrally formed at the distal end portion of the latch lever 47.

In the state where the color ink tank 4 is mounted to the tank holder 5, a height $H_2$ from the upper end surface of the latch pawl 48 for the latch lever 47 elastically displaced in the direction of the arrow $a_1$ with respect to the container 31 to the bottom surface of the container is set to be higher than a height $H_1$ from the upper end surface of the removal preventing pawl 46 to the bottom surface of the container.

Figure 8:
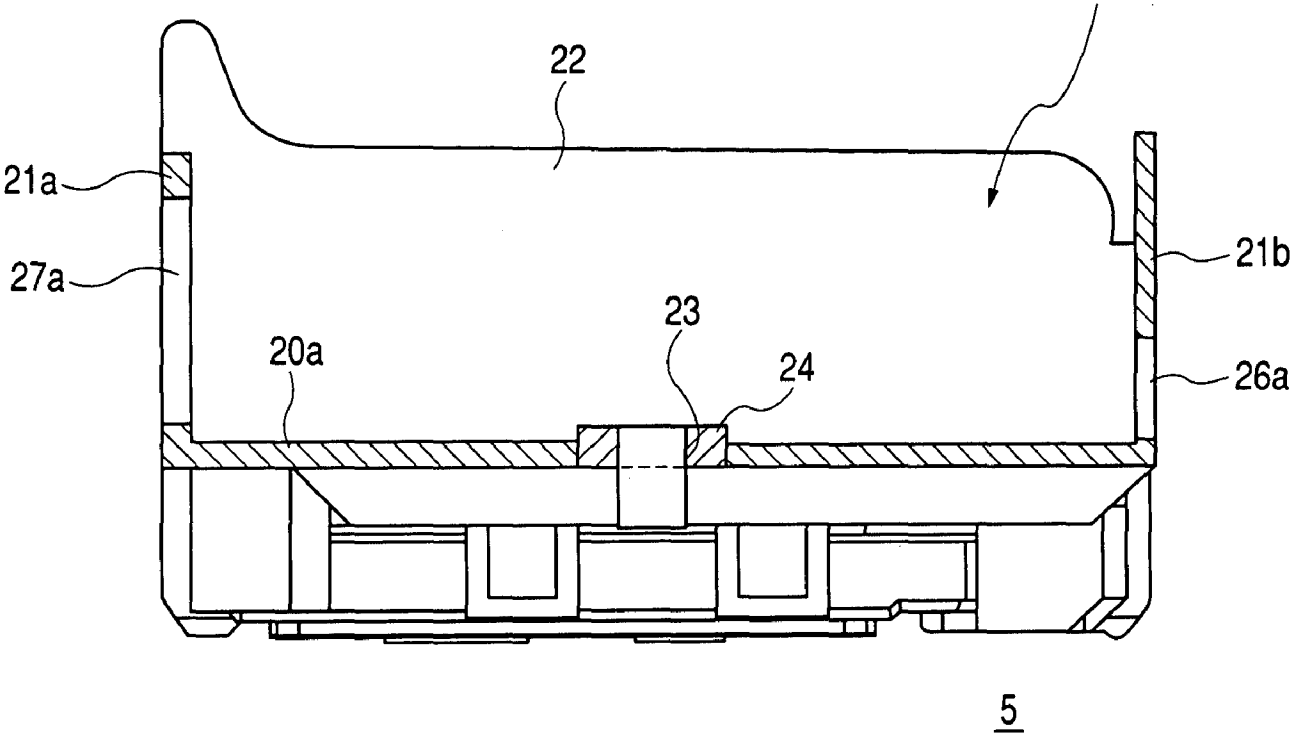
FIG. 8 is a cross-sectional view of the tank holder.

As illustrated in FIGS. 4 and 8, the tank holder 5 is formed in a substantially box shape with a bottom, and has a tank mounting portion 20 in which the black ink tank 3 and the color ink tank 4 are mounted so as to be adjacent with each other. The tank mounting portion 20 is provided with a peripheral wall 21 for surrounding outer peripherals of the black ink tank 3 and the color ink tank 4. The almost entire peripheral wall 21 is provided so as to be substantially perpendicular to a mounting surface 20*a* of the tank mounting portion 20. The tank mounting portion 20 is provided with a partition wall 22 for defining mounting areas for the black ink tank 3 and the color ink tank 4.

The peripheral wall 21 of the tank mounting portion 20 is provided with the removal preventing hall 26*a* which is engaged with the removal preventing pawl 36 of the black ink tank 3 at a rear wall 21*b* corresponding to the rear surface 31*b* of the black ink tank 3 with the removal preventing pawl 36 being provided thereon. Similarly, the rear wall 21*b* of the tank mounting portion 20 is provided with a removal preventing hole 26*b* which is engaged with the removal preventing pawl 46 of the color ink tank 4.

The peripheral wall 21 of the tank mounting portion 20 is provided with an engagement hole 27*a* which is engaged with the latch pawl 38 of the latch lever 37 for the black ink tank 3 at a rear wall 21*b* corresponding to the rear surface 31*b* of the black ink tank 3 with the latch lever 37 being provided thereon. Similarly, the rear wall 21*b* of the tank mounting portion 20 is also provided with an engagement hole 27*b* which is engaged with the latch pawl 48 of the latch lever 47 for the color ink tank 4.

Although not illustrated, in the tank holder 5, a height $H_2$ from the upper end surfaces of the engagement holes 27*a*, 27*b* that are respectively engaged with the latch pawls 38, 48 to the mounting surface 20*a* is set to be higher than a height $H_1$ from the upper end surfaces of the removal preventing holes 26*a*, 26*b* that are engaged with the removal preventing pawls 36, 46 to the mounting surface 20*a* as in cases of relative positions from the removal preventing pawls 36, 46 and the latch pawls 38, 48 to the bottom surface.

As illustrated in FIG. 7, in the tank mounting portion 20, the ink supplying tube 23 is provided on the mounting surface 20*a* on which the black ink tank 3 is mounted so as to correspond to the ink supplying port 33 of the black ink tank 3. This ink supplying tube 23 communicates via ink flow paths (not illustrated) with the discharge holes (not illustrated) on the nozzle lines for the recording head. The mounting surface 20*a* is provided with the seal ring 24 for suppressing ink leakage into the ink supplying tube 23.

Similarly in the tank mounting portion 20, three ink supplying tubes 28Y, 28M and 28C are provided on the mounting surface 20*a* on which the color ink tank 4 is mounted so as to correspond to the ink supplying ports 43Y, 43M and 43C for the color ink tank 4. The ink supplying tubes 28Y, 28M and 28C respectively communicate via ink flow paths (not illustrated) with predetermined discharge holes (not illustrated) on the nozzle lines for the recording head. The mounting surface 20*a* is provided with seal rings 29Y, 29M and 29C for suppressing ink leakages into the ink supplying tubes 28Y, 28M and 28C.

An operation of mounting the color ink tank 4 to the tank holder 5 will be described with reference to the drawings.

Figure 9:
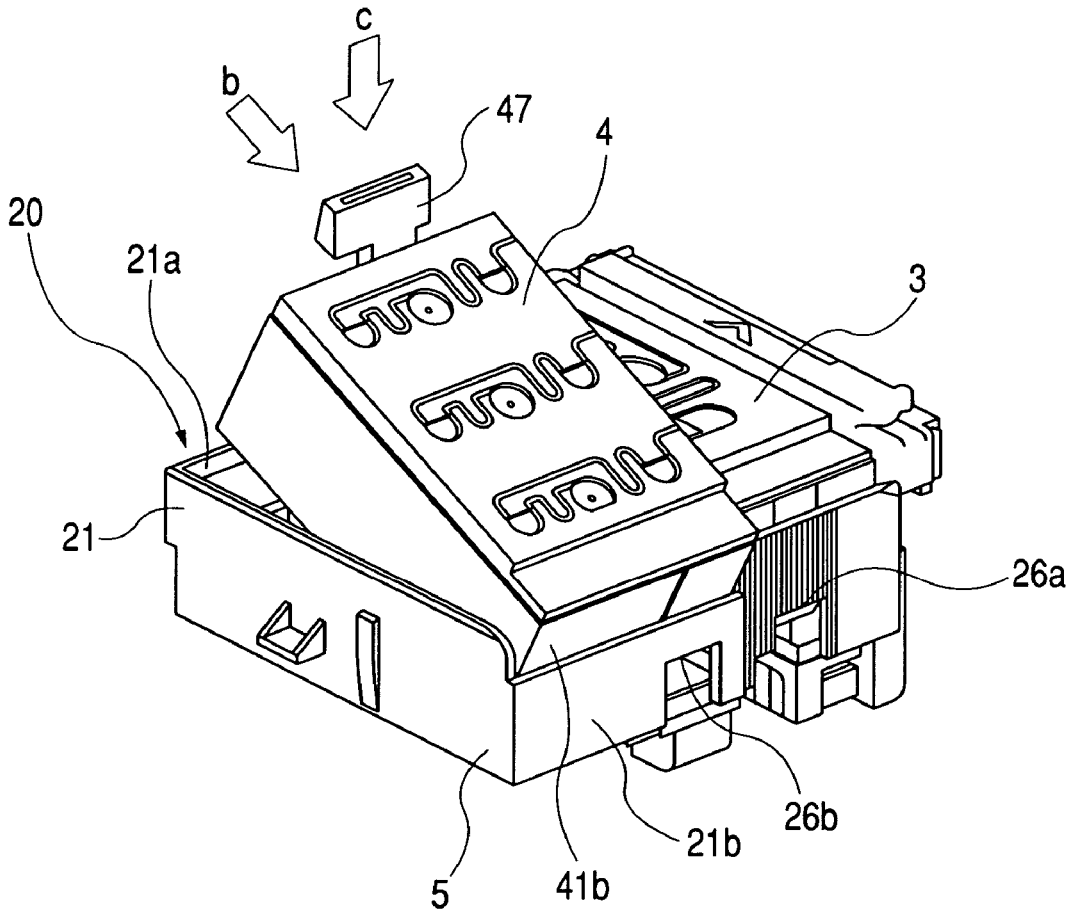
FIG. 9 is a perspective view illustrating the state where the ink tanks are being mounted to the tank holder.

Firstly, in order to mount the color ink tank 4 to the tank holder 5, the color ink tank 4 is inclined and then inserted from a direction indicated by the arrow b in FIG. 9 into the tank mounting portion 20 of the tank holder 5 so that the rear surface 41*b* with the removal preventing pawl 46 being formed thereon abuts the rear wall 21*b* of the tank holder 5 with the removal preventing hole 26*b* being provided thereon. In the color ink tank 4 which is inserted within the tank mounting portion 20 while being inclined, the removal preventing pawl 46 is engaged with the removal preventing hole 26*b* of the tank holder 5.

As illustrated in FIG. 9, the rear surface 41*b* of the color ink tank 4 with the removal preventing pawl 46 being provided thereon is supported at the rear wall 21*b* of the tank holder 5. Further, the color ink tank 4 is supported by the longitudinal direction central portion of the latch lever 47 at the front wall 21*a* of the tank holder 5. The color ink tank 4 is inclined and held with the top surface of the rear surface 41*b* with the removal preventing pawl 46 being protruded externally of the rear wall 21*b* of the tank holder 5.

Next, the color ink tank 4 is pressed downward, i.e., in a direction of the arrow c in FIG. 9 with respect to the tank holder 5. Then, the color ink tank 4 is rotated about the proximal end of the removal preventing pawl 46 and the latch pawl 48 of the latch lever 47 is engaged with the engagement hole 27*a* provided at the front wall 21*a* of the tank holder 5. In this way, the mounting operation is completed.

The operation of the ink tank at the time of being mounted to the tank holder 5 will be described in detail with reference to the drawings. In order to simply describe the operation of the ink tank, a description will be given by comparing the case that the center of rotation of the ink tank with respect to the tank holder 5 is positioned on the top surface of the ink tank to the case that the center of rotation is positioned on the bottom surface of the ink tank.

Figure 10:
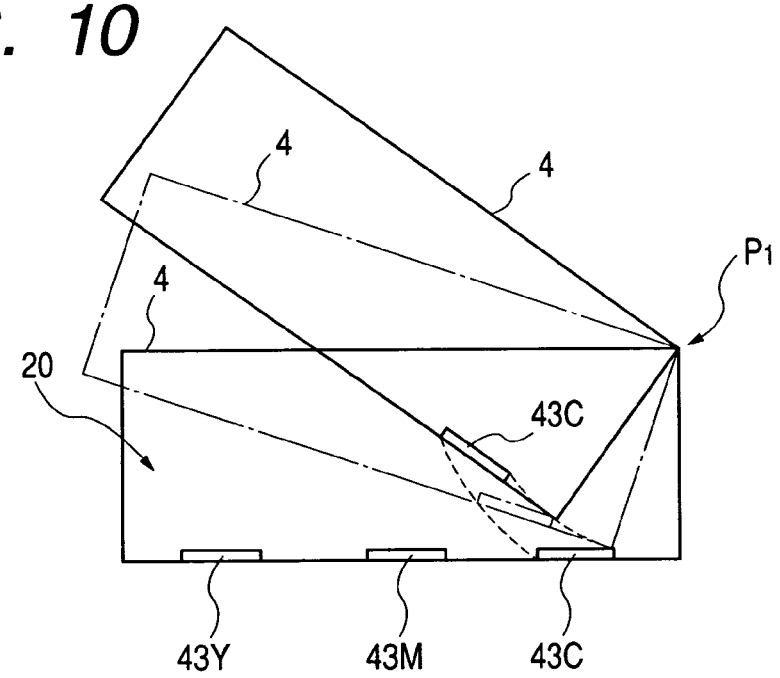
FIG. 10 is a typical view illustrating a locus of the color ink tank with respect to the tank holder in the case where its top surface is a center of rotation.
Figure 11:
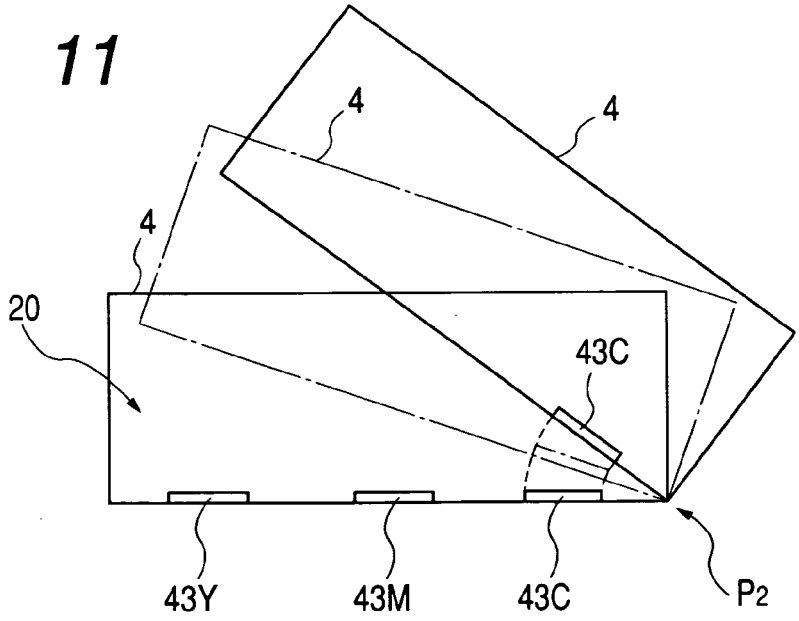
FIG. 11 is a typical view illustrating a locus of the color ink tank with respect to the tank holder in the case where its bottom surface is a center of rotation.

FIG. 10 is a typical view for explaining the operation of the color ink tank 4 with respect to the tank holder 5 in the case where the center of rotation $P_1$ is positioned on the top surface of the color ink tank 4. FIG. 11 is a typical view for explaining the operation of the color ink tank 4 with respect to the tank holder 5 in the case where the center of rotation $P_2$ is positioned on the bottom surface of the color ink tank 4.

In the case that the center of rotation $P_1$ of the color ink tank 4 is positioned on the top surface of the container 41, as illustrated in FIG. 10, when the color ink tank 4 is mounted to the tank holder 5, the ink supplying port 43C at the side of the removal preventing pawl 46 follows a locus which is displaced relatively large in a horizontal direction during the bottom surface of the color ink tank 4 being moved in a horizontal state. Accordingly, when the center of rotation $P_1$ of the color ink tank 4 is positioned on the top surface of the container 41, in order to prevent interferences of the ink supplying ports 43Y, 43M and 43C on the color ink tank 4 with the ink supplying tubes 28Y, 28M and 28C on the tank holder 5, opening diameters of the ink supplying ports 43Y, 43M and 43C must be formed so as to be relatively larger.

On the other hand, when the center of rotation $P_2$ of the color ink tank 4 is positioned on the bottom surface of the container 41, as illustrated in FIG. 11, the color ink tank 4 is moved upward so as to be substantially perpendicular to the mounting surface 20*a* of the tank holder 5. Thus, by placing the center of rotation $P_2$ of the color ink tank 4, i.e., the upper end of the rear wall 21 on the bottom surface of the container 41, the opening diameters of the ink supplying ports 43Y, 43M and 43C can be made smaller. Further, the ink supplying port 43C can be disposed in the vicinity of the removal preventing pawl 46.

As illustrated in FIGS. 10 and 11, a space required for attaching or detaching the color ink tank 4, i.e., a space in which the locus of the ink tank 4 passes is placed outside the tank holder 5. Thus, a waste space which is ensured within a conventional tank holder can be eliminated.

In order to protrude the top surface of the color ink tank 4 externally of the rear wall 21*b* of the tank holder 5 at the time of removing the color ink tank 4 from the tank holder 5, the height of the rear wall 21*b* must be formed so as to be lower than the height of the color ink tank 4 from its bottom surface. Namely, the rear surface 41*b* of the color ink tank 4 abuts the upper end of the rear wall 21*b* of the tank holder 5 and the color ink tank 4 is rotated about the substantial central portion of the rear surface 41*b* thereof. Thus, the color ink tank 4 can be easily rotated and the rotational operation of the color ink tank 4 is stabilized. Further, when the center of rotation is lowered from the substantial central portion toward the bottom surface side, the color ink tank 4 can be rotated even further easily. As a result, the height of the rear wall 21*b* of the tank holder 5 is preferably formed so as to be equal to or lower than ½ of the height of the color ink tank 4.

Because the structure of the black ink tank 3 is such that only one ink supplying port 33 is placed at the substantial central portion of the bottom surface, there remains a little space for aforementioned interference of the ink supplying port with the ink supplying tube. Comparing with the case of the color ink tank 4 having three ink supplying ports 43Y, 43M and 43C, in the black ink tank 3, the center of rotation may be placed at its top surface side.

In accordance with the tank holder 5 of this embodiment, in order to ensure an area for holding the tank holder 5 and a mechanical strength of the peripheral wall 21, the height of a part of the rear wall 21*b* corresponding to the black ink tank 3 from the mounting surface 20*a* is formed so as to be little higher than the height of a part of the rear wall 21*b* corresponding to the color ink tank 4 from the mounting surface 20*a*.

The color ink tank 4 is provided with the ink supplying ports 43Y, 43M and 43C along the longitudinal direction of the bottom surface, i.e., the direction perpendicular to the rear surface 41*b* with the removal preventing pawl 46 being formed thereon and the front surface 41*a* with the latch lever 47 being provided thereon. For this reason, when the color ink tank 4 is mounted to the tank holder 5, in accordance with the rotation of the color ink tank 4 with respect to the tank holder 5, the ink supplying ports 43Y, 43M and 43C are successively connected to the ink supplying tubes 28Y, 28M and 28C in this order from the rear surface 41*b* with the removal preventing pawl 46 being formed thereon. As a result, the color ink tank 4 is stably connected to the tank holder 5.

In order to remove the color ink tank 4 from the tank holder 5, the latch lever 47 is pressed in the direction of the arrow $a_1$ to be elastically displaced, so that the latch pawl 38 is disengaged from the engagement hole 27*a*. The proximal end portion of the latch lever 47 is provided at the container so as to be elastically displaced, and the latch lever 47 is inclined externally upward of the color ink tank 4. Thus, when the latch pawl 38 is disengaged from the engagement hole 27*a*, the latch lever 47 tends to return in the direction of the arrow $a_2$ because of its elastic force. For this reason, the inclined surface of the latch lever 47 provided at the outer peripheral surface of its proximal end side is slid along the upper end of the front wall 21*a* of the tank holder 5, and thus the color ink tank 4 is automatically lifted at its latch lever 47 side and inclined. By a user picking up the lifted portion of the color ink tank 4 with the fingers, the color ink tank 4 can be easily removed from the tank holder 5.

At this time, the removal preventing pawl 46 of the color ink tank 4 is, as illustrated in FIG. 9, offset upward from the bottom surface of the container. The removal preventing pawl 46 is formed at a position with the height $H_1$ from the bottom surface of the container 41 to its upper end surface. Further, the protruding amount J of the removal preventing pawl 46 from the rear surface 41*a* of the container 41 to its distal end is set to be smaller than the height $H_1$ thereof from the bottom surface, i.e., it is set so as to satisfy $J<H_1$. Thus, when the color ink tank 4 is removed from the tank holder 5, the interference of the removal preventing pawl 46 is prevented, i.e., its distal end is prevented from slide-contacting the mounting surface 20*a* of the tank holder 5 as illustrated in FIG. 10.

Figure 12:
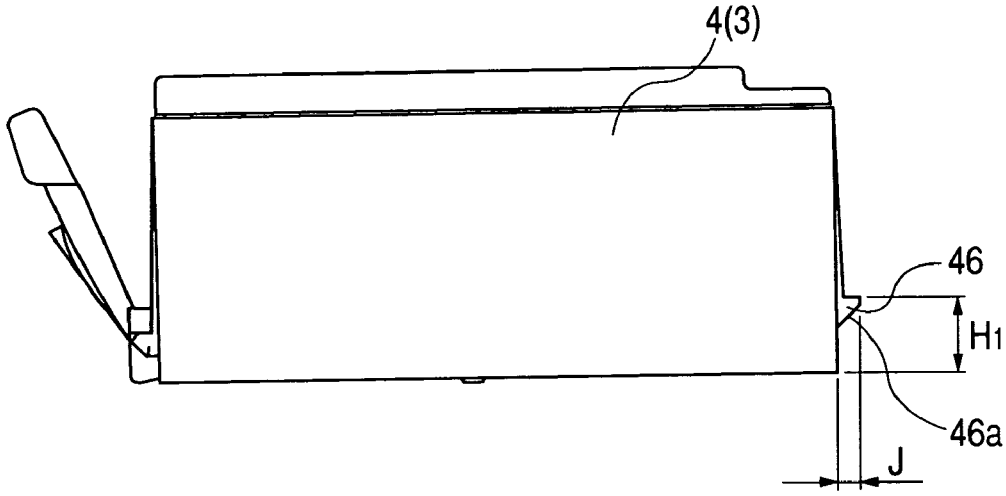
FIG. 12 is a side view for explaining the main portion of a removal preventing pawl for the color ink tank.
Figure 13:
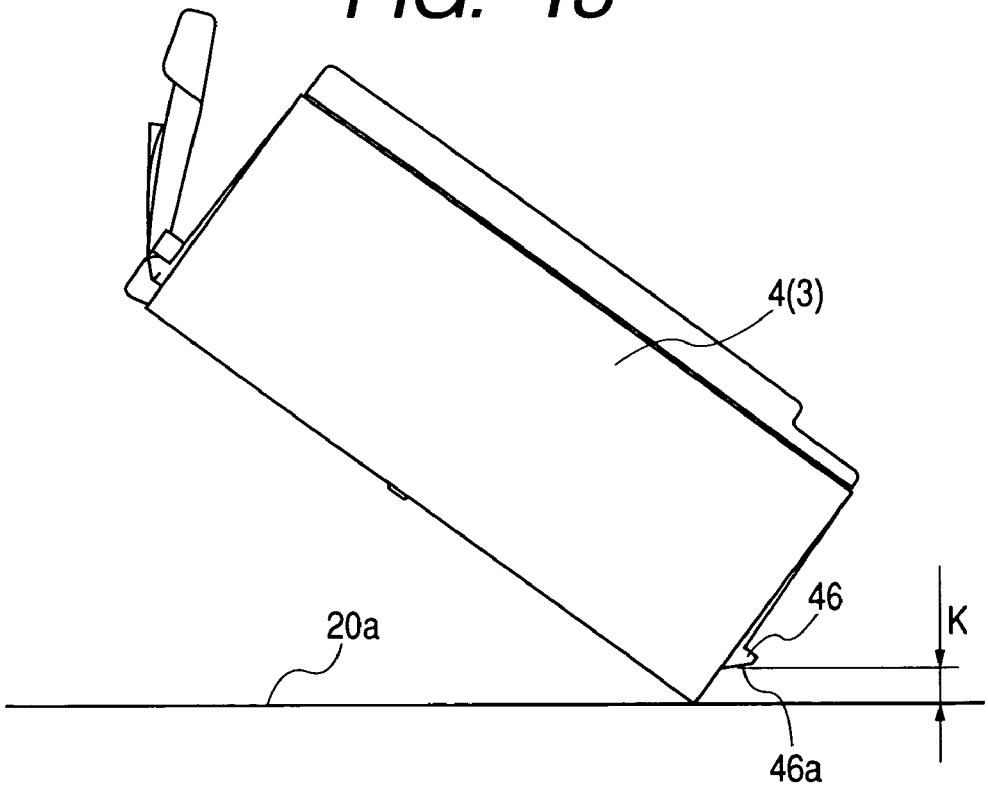
FIG. 13 is a side view illustrating the state where the color ink tank is removed from the tank holder.

As illustrated in FIG. 12, in accordance with the removal preventing pawl 46, the inclined surface 46*a* is formed by chamfering its lower end surface opposing the mounting surface 20*a* of the tank holder 5. As illustrated in FIG. 13, because the inclined surface 46*a* is formed at the lower end surface, when the color ink tank 4 is removed from the tank holder 5, a distance K that the inclined surface 46*a* is spaced apart from the mounting surface 20*a* of the tank holder 5 can be ensured so as to be relatively long. Thus, it is possible to further prevent the removal preventing pawl 46 from interfering with the mounting surface 20*a* of the tank holder 5.

The operations of attaching and detaching the color ink tank 4 with respect to the tank holder 5 have been described. Operations of attaching and detaching the black ink tank 3 with respect to the tank holder 5 are configured similarly to the operation of the color ink tank 4. The black ink tank 3 is configured so as to have only one ink supplying port 33. Thus, by forming the inclined surface 36*a* at the removal preventing pawl 36, a degree of freedom about the arrangement of the ink supplying port 33 can be improved.

Then, a description will be given with reference to the drawings of a case that the black ink tank 3 with the above-described structure is mounted to the tank mounting portion 20 of the tank holder 5 in a wrong manner.

Figure 14:
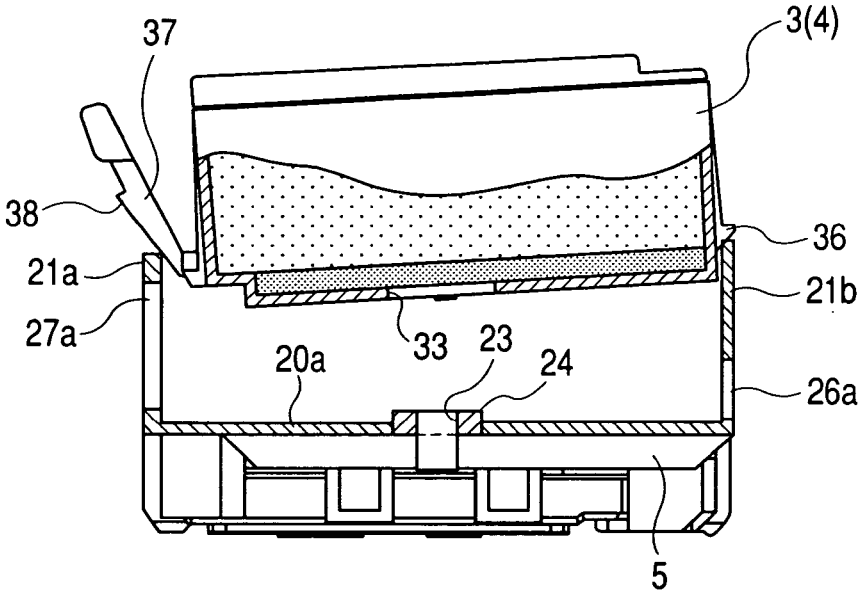
FIG. 14 is a cross-sectional view illustrating the state where the black ink tank is placed on a peripheral wall of tank mounting portion for the tank holder.

As illustrated in FIG. 14, the black ink tank 3 is firstly placed on the peripheral wall 21 of the tank mounting portion 20 for the tank holder 5.

Figure 15:
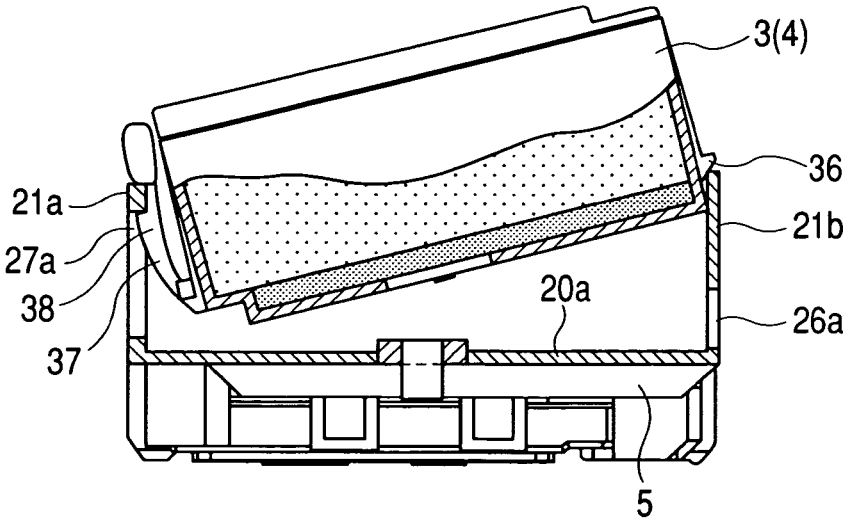
FIG. 15 is a cross-sectional view illustrating the state where the front surface side of the black ink tank is inserted into the tank holder in a wrong manner.

Then, as illustrated in FIG. 15, the upper surface of the front surface 31*a* of the black ink tank 3 with the latch lever 37 being formed thereat is pressed with respect to the tank holder 5, and the bottom surface of the black ink tank 3 is inclined with respect to the mounting surface 20 of the tank holder 5. The black ink tank 3 is fitted into the tank holder 5 under such state.

Figure 16:
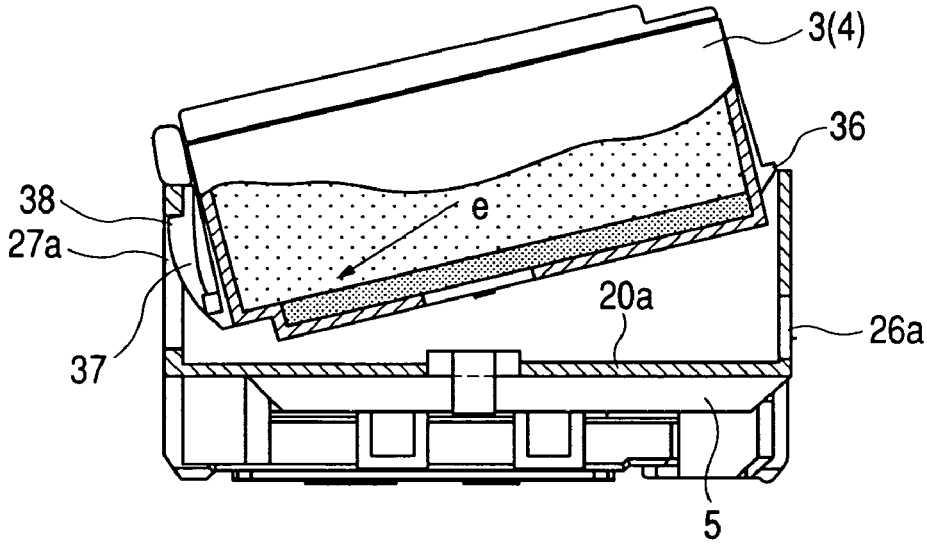
FIG. 16 is a cross-sectional view illustrating the state where the rear surface side of the black ink tank is inserted into the tank holder.

As illustrated in FIG. 16, the top surface portion of the front surface 31*a* of the black ink tank 3 with the removal preventing pawl 36 being formed thereon is pressed, and then an operation of mounting the black ink tank 3 to the tank mounting portion 20 starts. The inclined surface 36*a* is formed at the removal preventing pawl 36 from its proximal end with the container 31. Thus, the inclined surface 36*a* of the removal preventing pawl 36 abuts the upper end of the rear wall 21*b* of the tank holder 5 with the removal preventing hole 26*a* being provided thereon.

Figure 18:
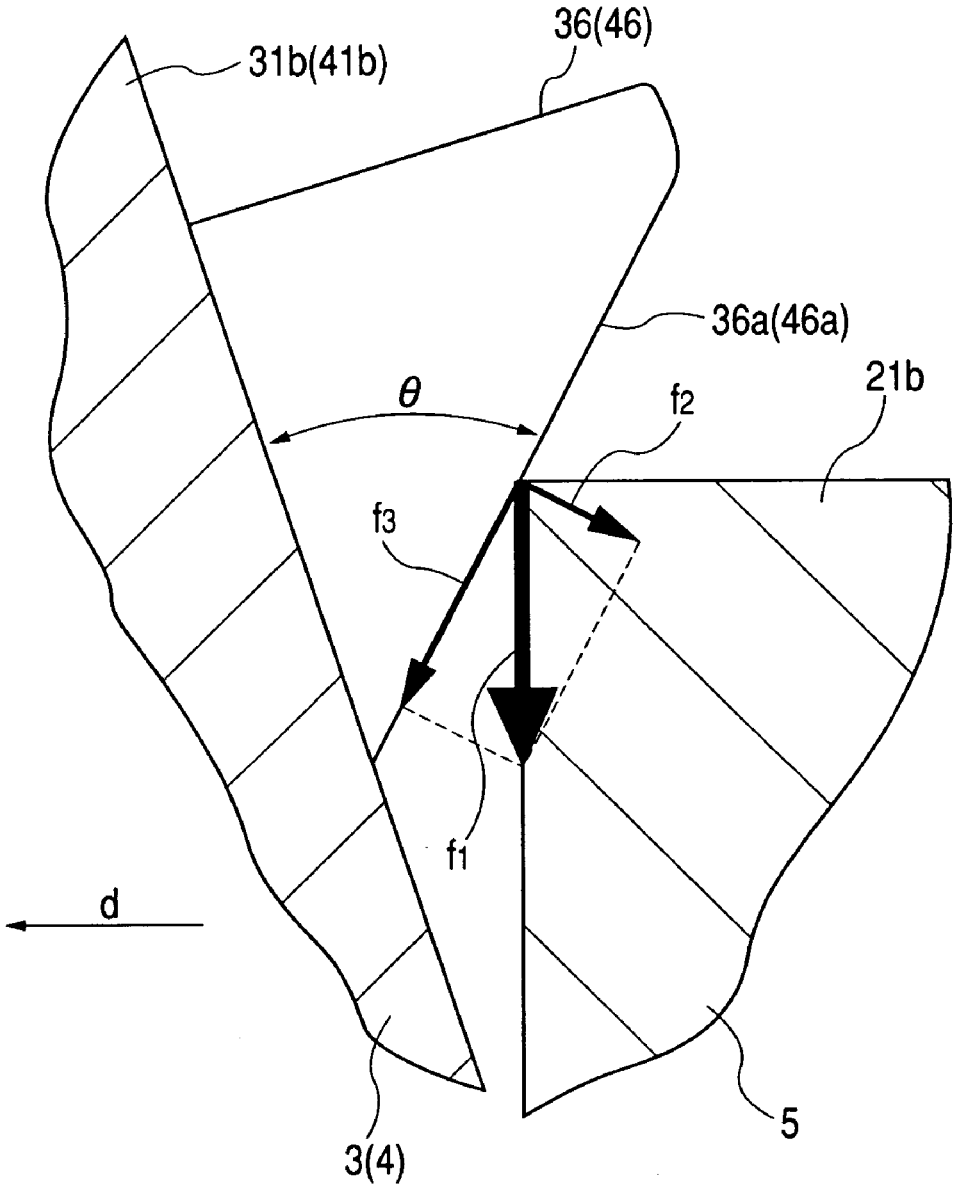
FIG. 18 is a typical view for explaining the state where a pressing force for pressing the ink tank with respect to the tank holder is decomposed.

As illustrated in FIG. 18, because the removal preventing pawl 36 is provided with the inclined surface 36*a*, a pressing force $f_1$ required for a user to mount the ink tanks 3 and 4 to the tank holder 5 is efficiently converted, with respect to a component force $f_2$ for pressing the upper end corner of the rear wall 21*b* of the tank holder 5, into a component force $f_3$ for moving backward the ink tanks 3 and 4, along the inner surface of the rear wall 21*b* of the tank holder 5, in a direction of the arrow d in FIG. 18, i.e., in a direction of deflecting the latch levers 37 and 47.

The inclined surface 36*a* of the removal preventing pawl 36 is inclined at an inclined angle θ of 45° or more with respect to a direction perpendicular to the rear surface 31*b*. Thus, assume that the latch lever 37 side of the ink tank 3 is firstly fallen into the tank mounting portion 20 prior to the removal preventing pawl 36 and then a mounting operation for fitting the removal preventing pawl 36 into the removal preventing hole 26*a* is performed. At this time, while the inclined surface 36*a* of the removal preventing pawl 36 being abutted against the upper end of the rear wall 21*b* of the tank holder 5, the inclined surface 36*a* of the removal preventing pawl 36 is inclined at an inclined angle of 45° or less with respect to a horizontal surface. For this reason, this is preferable because the pressing force $f_1$ for falling the black ink tank 3 into the tank mounting portion 20 effectively acts in the direction of pressing downward the black ink tank 3 toward the latch lever 37 side.

As illustrated in FIG. 16, when the removal preventing pawl 36 is slid along the rear wall 21*b* of the tank holder 5 so that the black ink tank 3 is moved within the tank mounting portion 20 in a direction of the arrow e in FIG. 16 while elastically displacing the latch lever 37. When the removal preventing pawl 36 is removed from the upper end of the rear wall 21*b* of the tank holder 5, the removal preventing pawl 36 of the black ink tank 3 is fallen vertically downward within the tank mounting portion 20. The black ink tank 3 is moved downward while being pressed toward the rear wall 21*b* side of the tank holder 5 by a reaction force caused by the elastic force of the latch lever 37.

Figure 17:
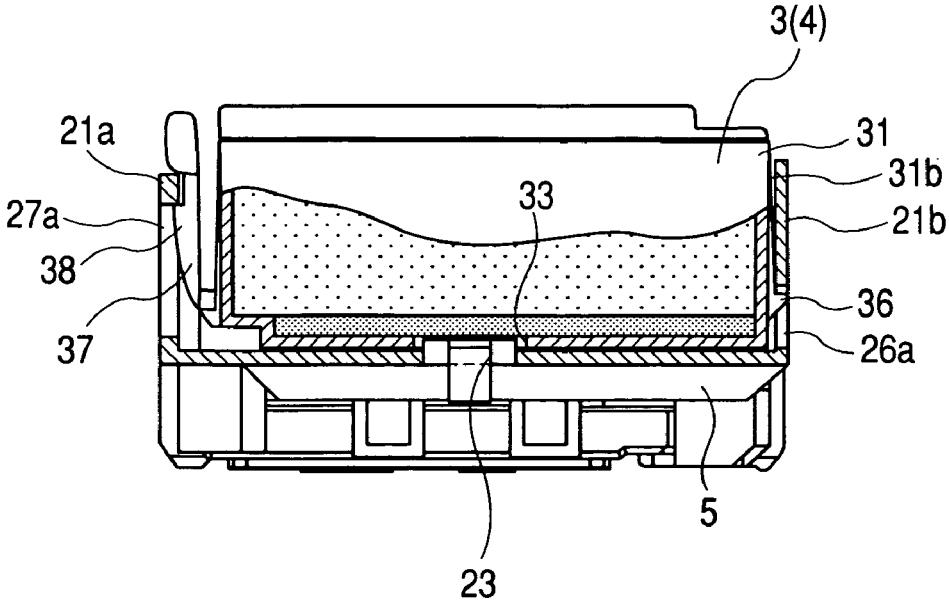
FIG. 17 is a cross-sectional view illustrating the state where the black ink tank is mounted to the tank holder.

As illustrated in FIG. 17, when the black ink tank 3 is fallen to the removal preventing hole 26*a* of the tank holder 5, the removal preventing pawl 36 is inserted into the removal preventing hole 26*a* by a reaction force caused by the elastic force of the latch lever 37 applied toward the side of the rear wall 21*b*, and then the mounting operation for the black ink tank 3 is completed. The color ink tank 4 is also mounted within the tank mounting portion 20 by the same mounting operation as the above-described operation.

As described above, in accordance with the ink tanks 3 and 4 of this embodiment, even if the ink tanks 3 and 4 start to be mounted by a user within the tank mounting portion 20 by the wrong mounting operation which is different from the above-described normal mounting operation which is originally assumed, the tanks 3 and 4 can be easily, correctly and normally mounted without damaging the tank holder 5 and the ink tanks 3 and 4.

In accordance with this embodiment, the operations of attaching and detaching the ink tanks 3 and 4 with respect to the recording head cartridge 1 in a state of single unit has been described. Nevertheless, even if the recording head cartridge 1 is mounted to a carriage for a recording apparatus to be described later, the attaching and detaching operations for the ink tanks 3 and 4 can be performed.

As described above, the recording head cartridge 1 is configured so as to be removed from the tank holder 5 by the rear surfaces 31*b* and 41*b* of the ink tanks 3 and 4 abutting the upper end of the rear wall 21*b* of the tank holder 5 and the ink tanks 3 and 4 rotated about this upper end. The ink tanks 3 and 4 are rotated so that the top surface portions of the rear surfaces 31*b* and 41*b* of the ink tanks 3 and 4 are protruded externally of the rear wall 21*b* of the tank holder 5. Thus, in accordance with this recording head cartridge 1, a space required for removing the ink tanks 3 and 4 from the tank holder 5 is placed external of the rear wall 21*b* of the tank holder 5. Thus, a waste space ensured within the aforementioned conventional tank holder in order to remove the ink tanks can be eliminated. As a result, the recording head cartridge 1 can be configured so as to be compact, and the tank holder 5 and the entire recording head cartridge 1 can be made compact and thin.

Further, the ink tanks 3 and 4 included in the recording head cartridge 1 respectively comprise the removal preventing pawls 36 and 46 that the protruding amount J from the rear surfaces 31*b* and 41*b* is smaller than the distance $H_1$ from the upper end surfaces of the pawls to the bottom surfaces of the tanks. Thus, when the ink tanks 3 and 4 are removed from the tank holder 5, it is possible to prevent the removal preventing pawls 36 and 46 interfering with the mounting surface 20*a* of the tank holder 5. Consequently, a degree of freedom for arranging the ink supplying port 33 provided at the ink tank 3 and the ink supplying ports 43Y, 43M and 43C provided at the ink tank 4 and the ink supplying tubes 23, 28Y, 28M and 28C provided at the tank holder 5 can be improved. In accordance with the ink tanks 3 and 4, the accommodating chambers accommodating inks can be easily formed by equally divided so as to have the same internal volume.

Further, the ink tanks 3 and 4 respectively have the removal preventing pawls 36 and 46 with the inclined surfaces 36*a* and 46*a* being formed thereat. Thus, the latch pawls 38 and 48 are firstly engaged with the engagement holes 27*a* and 27*b* of the tank holder 5, and then the removal preventing pawls 36 and 46 engaged on the upper end of the rear wall 21*b*of the tank holder 5 can be easily engaged with the removal preventing holes 26*a* and 26*b*. Namely, in accordance with these ink tanks 3 and 4, even if the ink tanks 3 and 4 start to be mounted to the tank holder 5 by the wrong mounting operation as described above, the ink tanks 3 and 4 can be easily and reliably mounted to the tank holder 5 without damaging the tank holder 5 and the ink tanks 3 and 4.

The recording head cartridge 1 comprises the tank holder 5 that the height $H_2$ from the upper end surfaces of the engagement holes 27*a* and 27*b* to the mounting surface 20*a* is higher than the height $H_1$ from the upper end surfaces of the removal preventing holes 26*a* and 26*b* to the mounting surface 20*a*. Thus, when the ink tanks 3 and 4 are removed from the tank holder 5, the center of rotation of the ink tanks 3 and 4 can be lowered toward the bottom surface side. When the ink tanks 3 and 4 are removed, the rear surfaces 31*b* and 41*b* with the removal preventing pawls 36 and 46 being provided thereon pass external of the tank holder 5 with respect to the upper end surfaces of the removal preventing holes 26*a* and 26*b* of the tank holder 5. Thus, a space within the tank holder 5 required for attaching and detaching the ink tanks 3 and 4 can be made smaller. As a result, compactness of the tank holder 5 can be realized.

A recording apparatus having the above-described recording head cartridge 1 will be briefly described.

Figure 19:
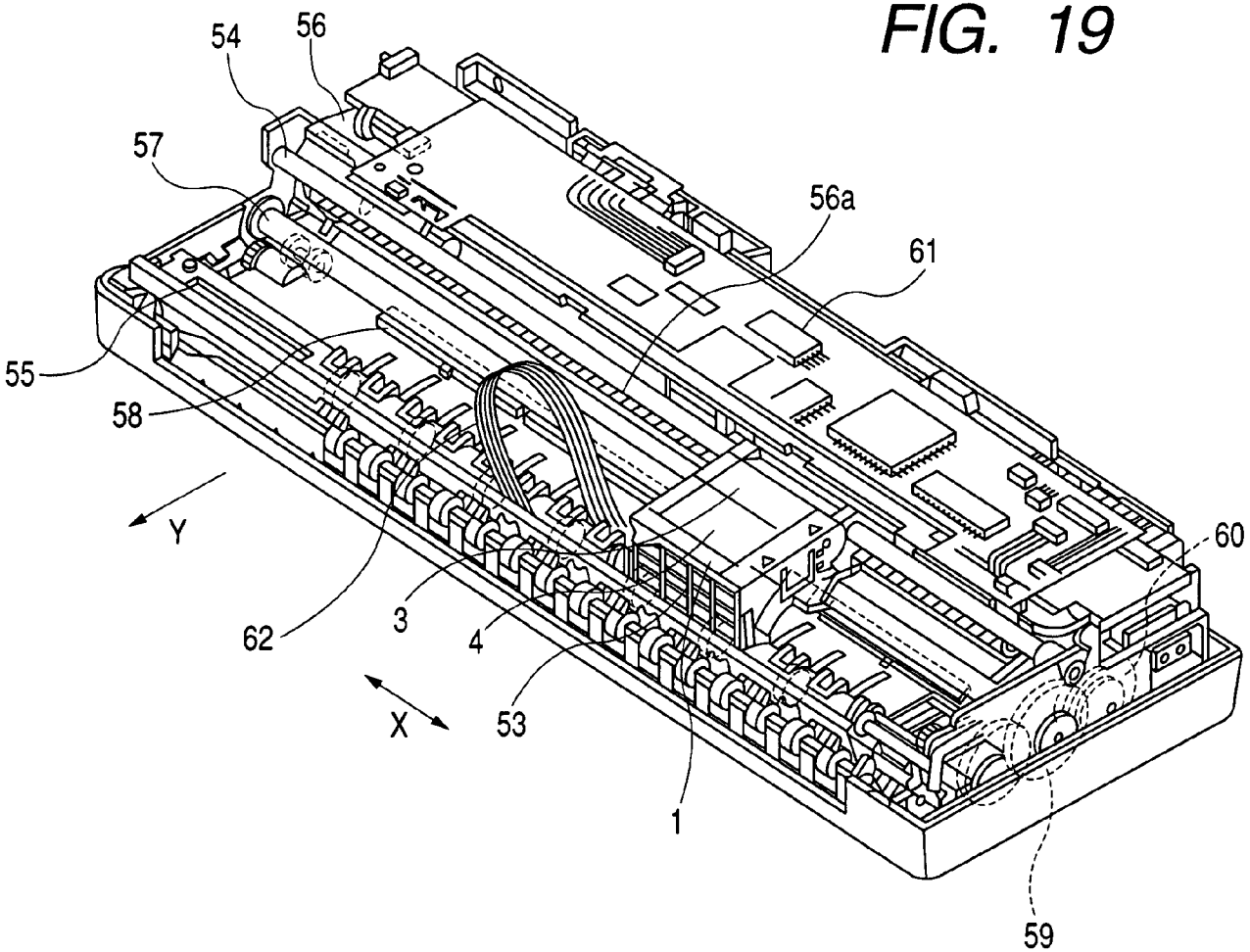
FIG. 19 is a perspective view of a recording apparatus of the present invention.

FIG. 19 is a perspective view illustrating the entire recording apparatus of this embodiment. As illustrated in FIG. 19, the recording apparatus is a general serial type recording apparatus. This recording apparatus repeats reciprocal operation (main scanning) of a recording head in a main scanning direction and conveyance (sub-scanning) of a recording sheet (recording medium) such as general recording paper, special paper or OHP film at a predetermined pitch in a sub-scanning direction and selectively ejects an ink from the recording head in synchronous with such operations to adhere to the recording sheet, so that characters, symbols and images are recorded in the recording sheet.

As illustrated in FIG. 19, the recording apparatus comprises the recording head cartridge 1, a carriage 53 for detachably holding this recording head cartridge 1, a guide shaft 54 and a guide rail 55 for movably supporting the carriage 53 in a direction of the arrow X in FIG. 19 (in a main-scanning direction), a transfer motor 56 for transferring the carriage 53 along the guide shaft 54 and the guide rail 55, a conveyance roller 57 and a pinch roller 58 for conveying a recording sheet and a conveyance motor 60 for rotatably driving the conveyance roller 57 and the pinch roller 58.

Figure 20:
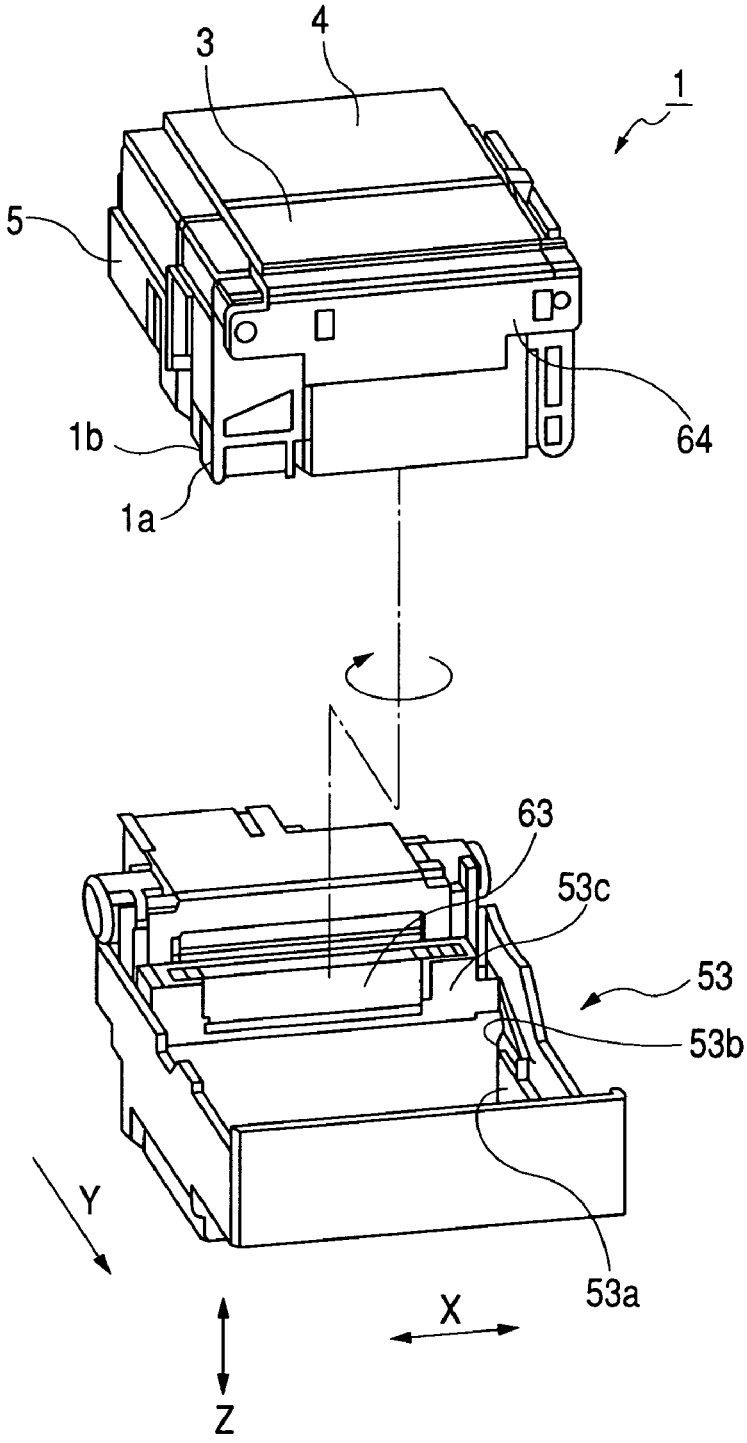
FIG. 20 is an exploded perspective view illustrating the state where a recording head cartridge is held by a carriage.

As illustrated in FIG. 20, the recording head cartridge 1 is detachably held within the carriage 53 together with the ink tanks 3 and 4 that accommodate inks used for recording. The carriage 53 is supported by the guide shaft 54 and the guide rail 55 fixed within the recording apparatus so as to be moved in the direction of the arrow X. The carriage 53 is driven via a carriage belt 56*a* by the transfer motor 56 so as to reciprocally scan.

As illustrated in FIG. 20, in the recording head cartridge 1, an X direction positioning surface la and a Y direction positioning surface 1*b* for positioning with respect to the carriage 53 are formed at the outer peripheral surface of the tank holder 5. Similarly, an X direction positioning surface 53*a* and a Y direction positioning surface 53*b* are formed at the carriage 53 that the X direction positioning surface 1*a* and the Y direction positioning surface 1*b* formed at the recording head cartridge 1 abut to be positioned.

In the carriage 53, a connector 63 that a terminal substrate 64 provided at the recording head cartridge 1 is electrically connected is provided in a connector holding portion 53*c*.

A recording sheet (not illustrated) on which recording is performed by the recording head is nipped by the conveyance roller 57 and the pinch roller 58 rotatably provided within the recording apparatus. By the conveyance roller 57 rotatably driven via a conveyance gear 59 by the conveyance motor 60, as illustrated in FIG. 19, the recording sheet is conveyed in a direction of the arrow Y (sub-scanning direction) which is perpendicular to the direction of the arrow X.

A control substrate 61 with a control circuit is provided within the recording apparatus. The control circuit on the control substrate 61 generates control signals to the recording head of the recording head cartridge 1, the transfer motor 56 and the conveyance motor 60 to drive-control such components. The recording head is electrically connected via a flexible cable 62 to the control substrate 61. During the recording head scanning in the direction of the arrow X, a control signal is transmitted via the flexible cable 62 between the recording head and the control substrate 61.

A drive signal for driving the recording head is transmitted from the control substrate 61 via the flexible cable 62, the connector 63 and the terminal substrate 64 to the recording head cartridge 1. The recording head of the recording head cartridge 1 discharges an ink on the basis of the drive signal from the control substrate 61 to record characters and images on a recording sheet.

As described above, because this recording apparatus comprises the compact recording head cartridge 1, the entire recording apparatus can be made compact and thin.

In order to accomplish the aforementioned object, a tank holder of the present invention comprises a liquid discharge head; a tank mounting portion to which a liquid tank for accommodating liquid to be supplied to the liquid discharge head is detachably mounted; a terminal for transmitting a recording signal to the liquid discharge head; a liquid supplying tube which is placed on the mounting surface of the mounting portion on which the liquid tank is mounted and supplies the liquid supplied from the liquid tank to the liquid discharge head; a peripheral wall which is provided upright around the mounting surface of the tank mounting portion and forms a space for accommodating the liquid tank; a first engagement portion which is provided at one side wall of the peripheral wall and engaged with a first engagement protrusion provided at a part of the liquid tank; and a second engagement portion which is provided at the other side wall of the peripheral wall opposing the one side wall and engaged with a second engagement protrusion provided at the other portion of the liquid tank.

The height of at least the one side wall of the peripheral wall is lower than the height of the liquid tank to be mounted, and when the liquid tank is mounted to the tank mounting portion, at least one side surface of the peripheral wall abuts the side surface of the liquid tank.

The height of the side surface of the holder corresponding to one side surface of a container is lower than that of the liquid tank. Thus, the container can be removed in such a manner that the one side surface of the container abuts the upper end of the peripheral wall for the tank holder and the container is rotated about the upper end so that a part of the one side surface of the container is protruded externally of the holder.

In accordance with this holder, a space required for removing the container from the tank holder is placed external of the peripheral wall of the tank holder. Thus, a waste space ensured within the aforementioned conventional tank holder in order to remove the liquid tank can be eliminated. For this reason, a head cartridge can be made compact, and the tank holder and the entire head cartridge can be made compact and thin.

A liquid tank configured so as to be attachable or detachable to the tank holder described above comprises a container main body for accommodating liquid; an air communication portion for communicating the inside of the container main body with air; a supplying port which is provided on the bottom surface of the container main body in the state the liquid tank is mounted to the tank holder and supplies the liquid to the liquid discharge head; a first engagement protrusion which is provided at one side surface of the liquid tank and engaged with the first engagement portion provided at one side wall of a peripheral wall for constituting the tank mounting portion; and a lever portion with a second engagement protrusion which is engaged with the second engagement portion provided at the other side wall of the peripheral wall opposing the one side wall and provided so as to be elastically displaced.

The protruding amount of the first engagement protrusion from one side surface of the liquid tank is smaller than the distance from the bottom surface of the container main body to the first engagement protrusion.

When the container is removed from the tank holder, it is possible to prevent the first engagement protrusion from interfering with the tank holder. As a result, a degree of freedom for disposing the supplying port on the container is improved.

The lower surface of the first engagement protrusion of the liquid tank opposing the bottom surface is preferably formed as an inclined surface which is inclined upward from its proximal end toward its distal end. Thus, a mounting force applied by a user acting at a time of mounting the tank is successfully distributed, so that the mounting is easily performed. Even if the liquid tank is mounted in a wrong manner, the tank is reliably mounted and thus a reliability for mounting is improved.

In a state where the container is mounted to the tank holder, the position of the second engagement protrusion for the liquid tank from the bottom surface is higher than that of the first engagement protrusion. Thus, when the container is removed from the tank holder, the one side surface with the first engagement protrusion being formed thereon passes externally of the tank holder with respect to the engagement portion of the tank holder engaged with the first engagement protrusion. As a result, a space required for attaching or detaching the liquid tank within the tank holder can be made smaller.

In the state where the container is mounted to the tank holder, the one side surface of the container for the liquid tank abuts the inner surface of the peripheral wall for the tank holder opposing the one side surface. When the container is removed from the tank holder, the one side surface of the container abuts the upper end of peripheral wall of the tank holder and the container is rotated about this upper end. It is configured so that the one side surface of the container abuts the upper end of peripheral wall of the tank holder and the container is rotated about this upper end, and thus the container is removed from the tank holder. The container is rotated so that a part of the one side surface for the container is protruded externally of the peripheral wall of the tank holder. In accordance with this liquid tank, because a space required for removing the container from the tank holder is placed external of the peripheral wall of the tank holder, a waste space ensured within the aforementioned conventional tank holder in order to remove the liquid tank can be eliminated. Accordingly, in accordance with the liquid tank, a head cartridge can be made compact and the tank holder and the entire head cartridge can be made compact and thin.

A center of rotation of the container for the liquid tank which abuts the upper end of the peripheral wall for the tank holder to be rotated is placed at a position which is equal to or lower than ½ of the height of the container from the bottom surface. Thus, the one side surface of the container abuts the upper end of peripheral wall of the tank holder and the container is rotated about the substantial central portion of the one side surface of the container. In this way, the container can be easily rotated. Further, the rotational operation of the container is stabilized. When the center of rotation is lowered from the substantial central portion toward the bottom surface, the container is further easily rotated.

What is claimed is:

1. A recording head cartridge comprising a tank holder, a black liquid tank which contains black liquid and which is held by said tank holder, and a color liquid tank which contains multiple ones of differently colored liquids and which is held by said tank holder, wherein said tank holder comprises:

a liquid discharge head;

a mounting portion including a mounting surface on which said black liquid tank and said color liquid tank are detachably mounted;

a terminal for transmitting a recording signal to said liquid discharge head;

plural liquid supplying ports on the mounting surface of said mounting portion which supply the liquids from said black liquid tank and said color liquid tank to said liquid discharge head;

a peripheral wall which is provided upright around said mounting surface of said mounting portion and which forms a space for accommodating said black liquid tank and said color liquid tank; and a pair of first and second engagement portions in said peripheral wall, wherein said first engagement portions are provided at one side wall of said peripheral wall and wherein said second engagement portions are provided at the other side wall of said peripheral wall opposing said one side wall, wherein the height of at least said one side wall of said peripheral wall is lower than the height of said black liquid tank and said color liquid tank, respectively, and when said black liquid tank and said color liquid tank are mounted to the mounting portion, at least one side surface of said peripheral wall abuts the side surfaces of said tanks, respectively, wherein both of said black liquid tank and said color liquid tank each comprises:

a container main body for accommodating liquid;

an air communication portion for communicating the inside of said container main body with air;

a supplying port which is provided on a bottom surface of said container main body in a state where the liquid tank is mounted to said tank holder and supplies liquid to said liquid discharge head;

a first engagement protrusion which is provided at one side surface of the liquid tank and which engages with a first engagement portion of one of said pairs of first and second engagement portions; and a lever portion with a second engagement protrusion which engages with a second engagement portion of said one of the pairs of first and second engagement portions, wherein said lever portion is provided so as to be elastically displaced, wherein the protruding amount of said first engagement protrusion from one side surface of the liquid tank is smaller than the distance from the bottom surface of said container main body to said first engagement protrusion, wherein in said tank holder, a height of said peripheral wall having the first engagement portion for said black liquid tank is higher than that for said color liquid tank, wherein of said plural liquid supplying ports, the liquid supplying ports corresponding to said color liquid tank are arranged along a straight line connecting the first and second engagement portions for the color liquid tank, and wherein said tank holder is constructed such that wen said color liquid container is dismounted from said tank holder, one side surface of said container abuts an upper end of said peripheral wall of said tank holder and said color liquid container is rotated with the upper end being a rotation point, and wherein a center of rotation of said container is at a position which is equal to or less than ½ of the eight of said container from its bottom surface.

2. The recording head cartridge according to claim 1, wherein the height of said peripheral wall at said second engagement portions from said mounting surface is higher than at said first engagement portions.

3. The recording head cartridge according to claim 1, wherein said mounting portion is divided into two areas so that said black liquid tank is mounted to one area and said color liquid tank accommodating three color inks is loaded onto the other area, the area of said mounting portion on which said black liquid tank is mounted is provided with a liquid supplying port for black ink and the area of said tank mounting portion on which said color liquid tank is mounted is provided with three liquid supplying ports for the respective colors.

4. The recording head cartridge according to claim 1, wherein when either of said black liquid tank or said color is dismounted from said mounting portion, one side surface of said liquid tank abuts an upper end of said one side wall of said peripheral wall, said one side surface of said liquid tank is supported by said upper end, and a rotational operation is utilized.

5. The recording head cartridge according to claim 1, wherein a lower surface side of each of said first engagement protrusions is formed in an inclined surface which is inclined upward from its proximal end toward its distal end.

6. The recording head cartridge according to claim 1, wherein when either of said black liquid container or said color liquid container is removed from said tank holder, said lever portion is elastically displaced toward the container side, so that the engagement state of said second engagement portion is released.

7. The recording head cartridge according to claim 1, wherein said lever portion for each of said black liquid container and said color liquid container is provided with an operating portion which is operated at the time of removing said liquid container from said tank holder.

8. The recording head cartridge according to claim 1, wherein in the state where each of said black liquid container and said color liquid container is mounted to said tank holder, the position of said second engagement protrusion from said bottom surface is higher than the position of said first engagement protrusion.

9. The recording head cartridge according to claim 1, wherein for each of said black liquid container and said color liquid container, said second engagement protrusion is placed, in the state of being engaged with said tank holder, at the inner side of said tank holder with respect to the outer peripheral surface of said peripheral wall of said tank holder.

10. The recording head cartridge according to claim 1, wherein each of said black liquid container and said color liquid container further comprises a negative pressure generator for holding liquid provided within said liquid container.

11. The recording head cartridge according to claim 1, wherein a fiber member made of fibrous material is provided on said supplying portion within said container.

12. The recording head cartridge according to claim 1, wherein for each of said black liquid container and said color liquid container, in a state where said liquid container is mounted to said tank holder, said one side surface of said liquid container abuts the inner surface of the peripheral wall of said tank holder opposing said one side surface, and when said liquid container is removed from said tank holder, said one side surface of said container abuts the upper end of said peripheral wall of said tank holder and said liquid container is rotated with the upper end being a rotation point.

13. The recording head cartridge according to claim 1, wherein said liquids are an ink.

* * * * *

UNITED STATES PATENT AND TRADEMARK OFFICE

CERTIFICATE OF CORRECTION

PATENT NO. : 6,997,548 B2
APPLICATION NO. : 10/667314
DATED : February 14, 2006
INVENTOR(S) : Keisuke Matsuo et al.

It is certified that error appears in the above-identified patent and that said Letters Patent is hereby corrected as shown below:

Title page (57)
IN THE ABSTRACT
Line 9, "an dis" should read --and is--.

COLUMN 2
Line 52, "diving" should read --divide--.

COLUMN 5
Line 1, "provided" should read --is provided--.

COLUMN 6
Line 13, "an" should read --a--.

COLUMN 9
Line 14, "hall 26a" should read --hole 26a--.

COLUMN 18
Line 45, "wen" should read --when--; and
Line 52, "eight" should read --height--.

COLUMN 19
Line 2, "color" should read --color liquid tank--.

Signed and Sealed this

Twenty-sixth Day of September, 2006

JON W. DUDAS
*Director of the United States Patent and Trademark Office*